US009335072B2

(12) United States Patent
Morimoto et al.

(10) Patent No.: US 9,335,072 B2
(45) Date of Patent: May 10, 2016

(54) AIR-CONDITIONING APPARATUS

(75) Inventors: Hiroyuki Morimoto, Chiyoda-ku (JP); Koji Yamashita, Chiyoda-ku (JP); Yuji Motomura, Chiyoda-ku (JP)

(73) Assignee: MITSUBISHI ELECTRIC CORPORATION, Chiyoda-Ku, Tokyo (JP)

( * ) Notice: Subject to any disclaimer, the term of this patent is extended or adjusted under 35 U.S.C. 154(b) by 713 days.

(21) Appl. No.: 13/581,776

(22) PCT Filed: Mar. 25, 2010

(86) PCT No.: PCT/JP2010/002104
§ 371 (c)(1),
(2), (4) Date: Aug. 29, 2012

(87) PCT Pub. No.: WO2011/117922
PCT Pub. Date: Sep. 29, 2011

(65) Prior Publication Data

US 2012/0324932 A1 Dec. 27, 2012

(51) Int. Cl.
*G05D 23/32* (2006.01)
*F25B 29/00* (2006.01)
(Continued)

(52) U.S. Cl.
CPC ..... *F25B 13/00* (2013.01); *F25B 25/005* (2013.01); *F25B 2313/023* (2013.01);
(Continued)

(58) Field of Classification Search
CPC ..... F25B 2313/023; F25B 25/005; F25B 2600/2513
USPC ..... 62/157, 324.1, 324.6, 159, 160, 185, 62/201, 222
See application file for complete search history.

(56) References Cited

U.S. PATENT DOCUMENTS 5,063,752 A * 11/1991 Nakamura et al. ..... 62/225
5,237,833 A * 8/1993 Hayashida et al. ..... 62/324.6
(Continued)

FOREIGN PATENT DOCUMENTS

JP 5-280818 A 10/1993
JP 2001-289465 A 10/2001
(Continued)

OTHER PUBLICATIONS

International Search Report (PCT/ISA/210) issued on May 18, 2010, by the Japanese Patent Office as the International Searching Authority for International Application No. PCT/JP2010/002104.
(Continued)

*Primary Examiner* — M. Alexandra Elve
*Assistant Examiner* — Henry Crenshaw
(74) *Attorney, Agent, or Firm* — Buchanan Ingersoll & Rooney PC

(57) ABSTRACT

To provide an air-conditioning apparatus that reduces large refrigerant noise generated when changing an operation mode. In an air-conditioning apparatus, when switching to a second operation mode from a first operation mode, switching to the second operation mode is performed after a predetermined time has elapsed after controlling either or all of expansion devices, controlling either or all of second flow switching devices, and controlling either or all of a first on-off device and a second on-off device such that a pressure difference of a heat source side refrigerant before and after each of the expansion devices is smaller compared to that in an operation state of the first operation mode.

5 Claims, 8 Drawing Sheets

(51) Int. Cl.

| | |
|---|---|
| ***F25B 13/00*** | (2006.01) |
| ***F25D 17/02*** | (2006.01) |
| ***F25B 41/04*** | (2006.01) |
| *F25B 25/00* | (2006.01) |

(52) U.S. Cl.

CPC ..... *F25B 2313/0272* (2013.01); *F25B 2313/02732* (2013.01); *F25B 2313/02741* (2013.01); *F25B 2500/12* (2013.01); *F25B 2600/2513* (2013.01)

(56) References Cited

U.S. PATENT DOCUMENTS

| | | | | |
|---|---|---|---|---|
| 2002/0194857 | A1* | 12/2002 | Kato et al. | 62/185 |
| 2003/0230105 | A1* | 12/2003 | Lee | 62/324.6 |
| 2003/0230107 | A1* | 12/2003 | Lee | 62/324.6 |
| 2004/0035132 | A1* | 2/2004 | Park et al. | 62/324.1 |
| 2004/0134215 | A1* | 7/2004 | Park et al. | 62/324.1 |
| 2004/0139755 | A1* | 7/2004 | Han Park et al. | 62/199 |
| 2004/0144111 | A1* | 7/2004 | Matsuoka | 62/224 |
| 2005/0150243 | A1* | 7/2005 | Matsuoka et al. | 62/324.1 |
| 2005/0155361 | A1* | 7/2005 | Jung et al. | 62/159 |
| 2006/0254294 | A1* | 11/2006 | Shimamoto et al. | 62/238.7 |
| 2007/0062207 | A1* | 3/2007 | Aiyama et al. | 62/222 |
| 2007/0101735 | A1* | 5/2007 | Matsui et al. | 62/160 |
| 2007/0234752 | A1* | 10/2007 | Otake et al. | 62/324.6 |
| 2007/0289319 | A1* | 12/2007 | Kim et al. | 62/175 |
| 2008/0196418 | A1* | 8/2008 | Lifson et al. | 62/80 |
| 2008/0197206 | A1* | 8/2008 | Murakami et al. | 237/2 B |
| 2009/0000329 | A1* | 1/2009 | Colberg et al. | 62/335 |
| 2009/0049857 | A1* | 2/2009 | Murakami et al. | 62/324.6 |
| 2009/0241577 | A1 | 10/2009 | Fukushima et al. | |
| 2009/0288437 | A1 | 11/2009 | Matsuoka et al. | |
| 2012/0324932 | A1* | 12/2012 | Morimoto et al. | 62/157 |

FOREIGN PATENT DOCUMENTS

| | | | |
|---|---|---|---|
| JP | 2003-240391 | A | 8/2003 |
| JP | 2003-343936 | A | 12/2003 |
| JP | 2005-140444 | A | 6/2005 |
| WO | WO 2005/095868 | A1 | 10/2005 |
| WO | WO 2009/133640 | A1 | 11/2009 |

OTHER PUBLICATIONS

Extended European Search Report dated Jan. 29, 2014, issued by the European Patent Office in corresponding European Patent Application No. 10848317.3 (7 pgs).

* cited by examiner

AIR-CONDITIONING APPARATUS

TECHNICAL FIELD

The present invention relates to an air-conditioning apparatus that is applied to, for example, a multi-air-conditioning apparatus for a building.

BACKGROUND ART

In an air-conditioning apparatus such as a multi-air-conditioning apparatus for a building, a refrigerant is circulated between an outdoor unit, which is a heat source unit disposed, for example, outside a building, and indoor units disposed in rooms in the building. The refrigerant transfers heat or removes heat to heat or cool air, thus heating or cooling an air conditioned space through the heated or cooled air. Hydrofluorocarbon (HFC) refrigerants are often used as the refrigerant, for example. An air-conditioning apparatus using a natural refrigerant, such as carbon dioxide ($CO_2$), has also been proposed.

Furthermore, in an air-conditioning apparatus called a chiller, cooling energy or heating energy is generated in a heat source unit disposed outside a structure. Water, antifreeze, or the like is heated or cooled by a heat exchanger disposed in an outdoor unit and it is carried to an indoor unit, such as a fan coil unit or a panel heater, to perform heating or cooling (see Patent Literature 1, for example).

Moreover, there is an air-conditioning apparatus called a heat recovery chiller that connects a heat source unit to each indoor unit with four water pipings arranged therebetween, supplies cooled and heated water or the like simultaneously, and allows the cooling and heating in the indoor units to be selected freely (see Patent Literature 2, for example).

In addition, there is an air-conditioning apparatus that disposes a heat exchanger for a primary refrigerant and a secondary refrigerant near each indoor unit in which the secondary refrigerant is carried to the indoor unit (see Patent Literature 3, for example).

Furthermore, there is an air-conditioning apparatus that connects an outdoor unit to each branch unit including a heat exchanger with two pipings in which a secondary refrigerant is carried to an indoor unit (see Patent Literature 4, for example).

CITATION LIST

Patent Literature

Patent Literature 1: Japanese Unexamined Patent Application Publication No. 2005-140444 (p. 4, FIG. 1, for example)

Patent Literature 2: Japanese Unexamined Patent Application Publication No. 5-280818 (pp. 4 and 5, FIG. 1, for example)

Patent Literature 3: Japanese Unexamined Patent Application Publication No. 2001-289465 (pp. 5 to 8, FIG. 1, FIG. 2, for example)

Patent Literature 4: Japanese Unexamined Patent Application Publication No. 2003-343936 (p. 5, FIG. 1)

SUMMARY OF INVENTION

Technical Problem

In an air-conditioning apparatus of the related art, such as a multi-air-conditioning apparatus for a building, there is a possibility of refrigerant leakage to, for example, an indoor space since the refrigerant is circulated to an indoor unit. On the other hand, in the air-conditioning apparatus disclosed in Patent Literature 1 and Patent Literature 2, the refrigerant does not pass through the indoor unit. However, in the air-conditioning apparatus disclosed in Patent Literature 1 and Patent Literature 2, the heat medium needs to be heated or cooled in a heat source unit disposed outside a structure, and needs to be carried to the indoor unit side. Accordingly, a circulation path of the heat medium becomes long. In this case, carrying of heat for a predetermined heating or cooling work using the heat medium consumes more amount of energy, in the form of conveyance power and the like, than the amount of energy consumed by the refrigerant. Accordingly, as the circulation path becomes long, the conveyance power becomes markedly large. This indicates that energy saving can be achieved in an air-conditioning apparatus if the circulation of the heat medium can be controlled appropriately.

In the air-conditioning apparatus disclosed in Patent Literature 2, the four pipings connecting the outdoor side and the indoor space need to be arranged in order to allow cooling or heating to be selectable in each indoor unit. Disadvantageously, there is little ease of construction. In the air-conditioning apparatus disclosed in Patent Literature 3, secondary medium circulating means such as a pump needs to be provided to each indoor unit. Disadvantageously, the system is not only costly but also creates a large noise, and is not practical. In addition, since the heat exchanger is disposed near each indoor unit, risk of refrigerant leakage to a place near the indoor space cannot be eliminated.

In the air-conditioning apparatus disclosed in Patent Literature 4, a primary refrigerant that has exchanged heat flows into the same passage as that of the primary refrigerant before heat exchange. Accordingly, when a plurality of indoor units are connected, it is difficult for each indoor unit to exhibit its maximum capacity. Such a configuration wastes energy. Furthermore, each branch unit is connected to an extension piping with a total of four pipings, two for cooling and two for heating. This configuration is consequently similar to that of a system in which the outdoor unit is connected to each branching unit with four pipings. Accordingly, there is little ease of construction in such a system.

The present invention has been made to overcome the above-described problems, and a first object thereof is to provide an air-conditioning apparatus capable of achieving energy saving. In some aspects of the present invention, a second object is to provide an air-conditioning apparatus capable of increasing its safety by not circulating the refrigerant to or near an indoor unit. In some aspects of the present invention, a third object is to provide an air-conditioning apparatus capable of increasing ease of construction and increasing energy efficiency by reducing the connecting piping between an outdoor unit and a branch unit (heat medium relay unit) or the connecting piping between the branch unit and an indoor unit. Further, in some aspects of the present invention, a fourth object is to provide an air-conditioning apparatus that reduces large refrigerant noise generated when changing an operation mode.

Solution to Problem

The air-conditioning apparatus according to the invention includes a refrigerant circuit in which a compressor, a first refrigerant flow switching device, a heat source side heat exchanger, a plurality of expansion devices, refrigerant side passages of a plurality of heat exchangers related to heat medium, and a plurality of second refrigerant flow switching devices are connected by refrigerant piping circulating a heat source side refrigerant; a heat medium circuit in which a pump, a use side heat exchanger, and heat medium side passages of the heat exchangers related to heat medium are connected by heat medium piping circulating a heat medium; and the heat source side refrigerant and the heat medium exchanging heat in the heat exchangers related to heat medium, in which the air-conditioning apparatus has a first operation mode that operates in a predetermined state, and a second operation mode that operates in a state different from the first operation mode, when switching an operation from the first operation mode to the second operation mode, switching to the second operation mode is performed after a predetermined time has elapsed after controlling either or all of the expansion devices and controlling either or all of the second flow switching devices such that a pressure difference of the heat source side refrigerant before and after each of the expansion devices is smaller compared to that in the operation state of the first operation mode.

Advantageous Effects of Invention

According to the air-conditioning apparatus of the invention, the pipings in which the heat medium circulates can be shortened and small conveyance power is required, and thus, safety is increased and energy is saved. Furthermore, according to the air-conditioning apparatus of the invention, even if the heat medium should leak out, it will be a small amount. Accordingly, safety is further increased. Furthermore, according to the air-conditioning apparatus of the invention, large refrigerant noise generated when switching operation modes can be reduced, thus, comfortability can be improved.

DESCRIPTION OF EMBODIMENT

Embodiment of the present invention will be described below with reference to the drawings.

Figure 1:
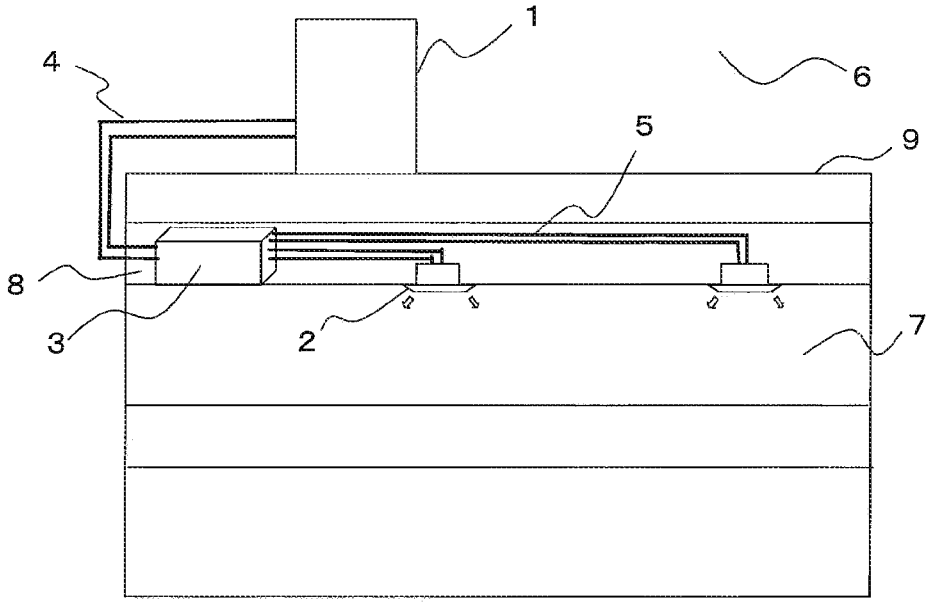
FIG. 1 is a schematic diagram illustrating an exemplary installation of an air-conditioning apparatus according to Embodiment of the invention.
Figure 2:
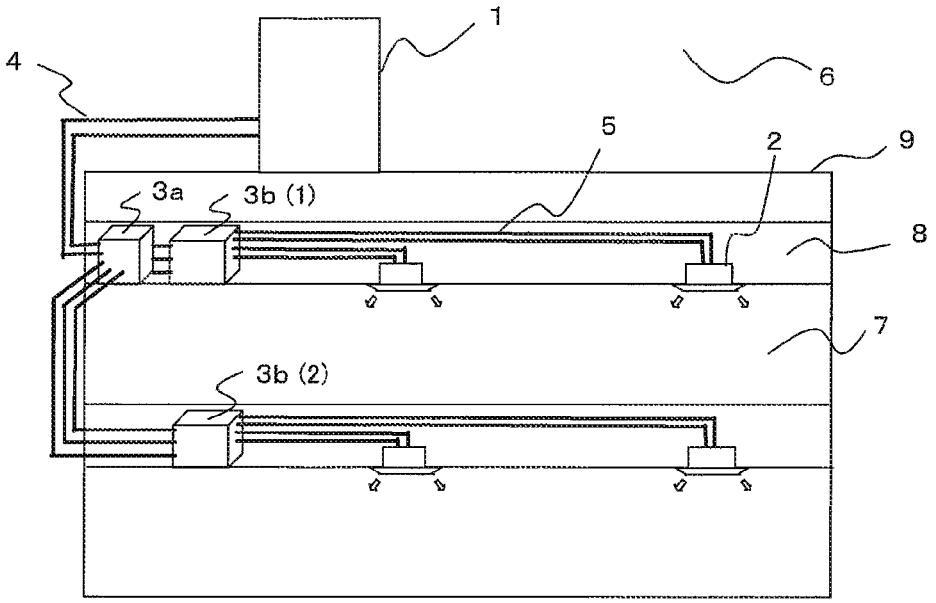
FIG. 2 is a schematic diagram illustrating another exemplary installation of an air-conditioning apparatus according to Embodiment of the invention.

FIG. 1 is a schematic diagram illustrating an exemplary installation of an air-conditioning apparatus according to Embodiment of the invention. FIG. 2 is a schematic diagram illustrating another exemplary installation of an air-conditioning apparatus according to Embodiment of the invention. The exemplary installations of the air-conditioning apparatus will be described with reference to FIGS. 1 and 2. This air-conditioning apparatus uses refrigeration cycles (a refrigerant circuit A and a heat medium circuit B) in which refrigerants (a heat source side refrigerant or a heat medium) circulate such that a cooling mode or a heating mode can be freely selected as its operation mode in each indoor unit. It should be noted that the dimensional relationships of components in FIG. 1 and other subsequent figures may be different from the actual ones.

Referring to FIG. 1, the air-conditioning apparatus according to Embodiment includes a single outdoor unit 1, functioning as a heat source unit, a plurality of indoor units 2, and a heat medium relay unit 3 disposed between the outdoor unit 1 and the indoor units 2. The heat medium relay unit 3 exchanges heat between the heat source side refrigerant and the heat medium. The outdoor unit 1 and the heat medium relay unit 3 are connected with refrigerant pipings 4 through which the heat source side refrigerant flows. The heat medium relay unit 3 and each indoor unit 2 are connected with pipings 5 (heat medium pipings) through which the heat medium flows. Cooling energy or heating energy generated in the outdoor unit 1 is delivered through the heat medium relay unit 3 to the indoor units 2.

Referring to FIG. 2, the air-conditioning apparatus according to Embodiment includes the single outdoor unit 1 serving as a heat source unit, the plurality of indoor units 2, a plurality of separated heat medium relay units 3 (a main heat medium relay unit 3*a* and sub heat medium relay units 3*b*) disposed between the outdoor unit 1 and the indoor units 2. The outdoor unit 1 and the main heat medium relay unit 3*a* are connected with the refrigerant pipings 4. The main heat medium relay unit 3*a* and the sub heat medium relay units 3*b* are connected with the refrigerant pipings 4. Each sub heat medium relay unit 3*b* and the corresponding indoor unit 2 are connected with the pipings 5. Cooling energy or heating energy generated in the outdoor unit 1 is delivered through the main heat medium relay unit 3*a* and the sub heat medium relay units 3*b* to the indoor units 2.

The outdoor unit 1 is typically disposed in an outdoor space 6 that is a space (e.g., a roof) outside a structure 9, such as a building, and is configured to supply cooling energy or heating energy through the heat medium relay unit 3 to the indoor units 2. Each indoor unit 2 is disposed at a position that can supply cooling air or heating air to an indoor space 7, which is a space (e.g., a living room) inside the structure 9, and supplies air for cooling or air for heating to the indoor space 7 that is an air conditioned space. The heat medium relay unit 3 is configured with a housing separate from the outdoor unit 1 and the indoor units 2 such that the heat medium relay unit 3 can be disposed at a position different from those of the outdoor space 6 and the indoor space 7, and is connected to the outdoor unit 1 through the refrigerant pipings 4 and is connected to the indoor units 2 through the pipings 5 to convey cooling energy or heating energy, supplied from the outdoor unit 1 to the indoor units 2.

As illustrated in FIGS. 1 and 2, in the air-conditioning apparatus according to Embodiment, the outdoor unit 1 is connected to the heat medium relay unit 3 using two refrigerant pipings 4, and the heat medium relay unit 3 is connected to each indoor unit 2 using two pipings 5. As described above, in the air-conditioning apparatus according to Embodiment, each of the units (the outdoor unit 1, the indoor units 2, and the heat medium relay unit 3) is connected using two pipings (the refrigerant pipings 4 or the pipings 5), thus construction is facilitated.

As illustrated in FIG. 2, the heat medium relay unit 3 can be separated into a single main heat medium relay unit 3*a* and two sub heat medium relay units 3*b* (a sub heat medium relay unit 3*b*(1) and a sub heat medium relay unit 3*b*(2)) derived from the main heat medium relay unit 3*a*. This separation allows a plurality of sub heat medium relay units 3*b* to be connected to the single main heat medium relay unit 3*a*. In this configuration, the number of refrigerant piping 4 connecting the main heat medium relay unit 3*a* to each sub heat medium relay unit 3*b* is three. Detail of this circuit will be described in detail later (see FIG. 4).

Furthermore, FIGS. 1 and 2 illustrate a state where each heat medium relay unit 3 is disposed in the structure 9 but in a space different from the indoor space 7, for example, a space above a ceiling (hereinafter, simply referred to as a "space 8"). The heat medium relay unit 3 can be disposed in other spaces, such as a common space where an elevator or the like is installed. In addition, although FIGS. 1 and 2 illustrate a case in which the indoor units 2 are of a ceiling-mounted cassette type, the indoor units are not limited to this type and, for example, a ceiling-concealed type, a ceiling-suspended type, or any type of indoor unit may be used as long as the unit can blow out heating air or cooling air into the indoor space 7 directly or through a duct or the like.

FIGS. 1 and 2 illustrate the case in which the outdoor unit 1 is disposed in the outdoor space 6. The arrangement is not limited to this case. For example, the outdoor unit 1 may be disposed in an enclosed space, for example, a machine room with a ventilation opening, may be disposed inside the structure 9 as long as waste heat can be exhausted through an exhaust duct to the outside of the structure 9, or may be disposed inside the structure 9 when the used outdoor unit 1 is of a water-cooled type. Even when the outdoor unit 1 is disposed in such a place, no problem in particular will occur.

Furthermore, the heat medium relay unit 3 can be disposed near the outdoor unit 1. It should be noted that when the distance from the heat medium relay unit 3 to the indoor unit 2 is excessively long, because power for conveying the heat medium is significantly large, the advantageous effect of energy saving is reduced. Additionally, the numbers of connected outdoor units 1, indoor units 2, and heat medium relay units 3 are not limited to those illustrated in FIGS. 1 and 2. The numbers thereof can be determined in accordance with the structure 9 where the air-conditioning apparatus according to Embodiment is installed.

Figure 3:
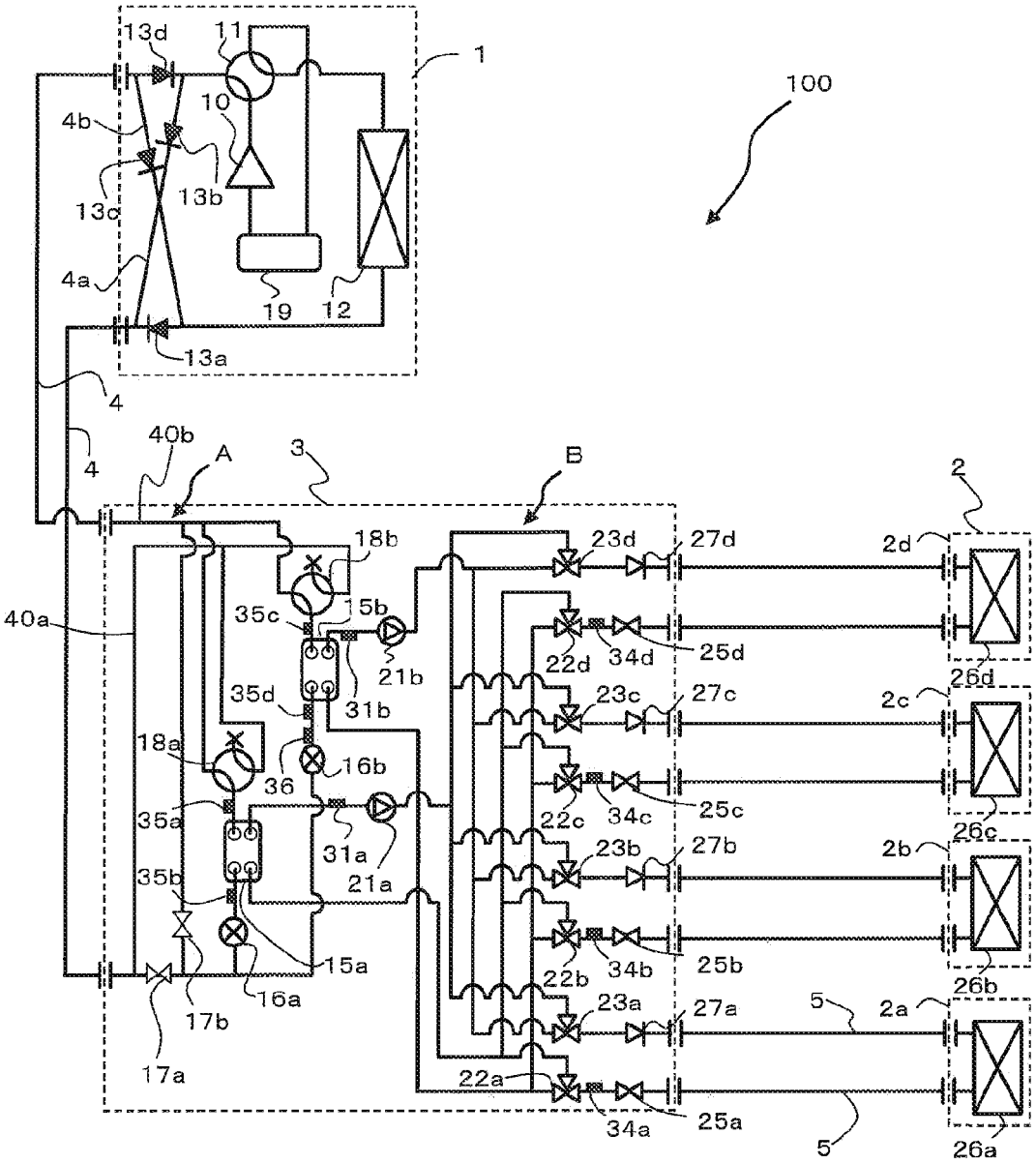
FIG. 3 is a schematic circuit diagram illustrating an exemplary circuit configuration of the air-conditioning apparatus according to Embodiment of the invention.

FIG. 3 is a schematic circuit diagram illustrating an exemplary circuit configuration of the air-conditioning apparatus (hereinafter, referred to as an "air-conditioning apparatus 100") according to Embodiment of the invention. The detailed configuration of the air-conditioning apparatus 100 will be described with reference to FIG. 3. As illustrated in FIG. 3, the outdoor unit 1 and the heat medium relay unit 3 are connected with the refrigerant pipings 4 through heat exchangers related to heat medium 15*a* and 15*b* included in the heat medium relay unit 3. Furthermore, the heat medium relay unit 3 and the indoor units 2 are connected with the pipings 5 through the heat exchangers related to heat medium 15*a* and 15*b*. Note that the refrigerant piping 4 will be described in detail later.

[Outdoor Unit 1]

The outdoor unit 1 includes a compressor 10, a first refrigerant flow switching device 11, such as a four-way valve, a heat source side heat exchanger 12, and an accumulator 19, which are connected in series with the refrigerant pipings 4. The outdoor unit 1 further includes a first connecting piping 4*a*, a second connecting piping 4*b*, a check valve 13*a*, a check valve 13*b*, a check valve 13*c*, and a check valve 13*d*. By providing the first connecting piping 4*a*, the second connecting piping 4*b*, the check valve 13*a*, the check valve 13*b*, the check valve 13*c*, and the check valve 13*d*, the heat source side refrigerant can be made to flow into the heat medium relay unit 3 in a constant direction irrespective of the operation requested by the indoor units 2.

The compressor 10 sucks in the heat source side refrigerant and compresses the heat source side refrigerant to a high-temperature high-pressure state. The compressor 10 may include, for example, a capacity-controllable inverter compressor. The first refrigerant flow switching device 11 switches the flow of the heat source side refrigerant between a heating operation mode (heating only operation mode and heating main operation mode) and a cooling operation mode (cooling only operation mode and cooling main operation mode).

The heat source side heat exchanger 12 functions as an evaporator in the heating operation, functions as a condenser (or a radiator) in the cooling operation, exchanges heat between air supplied from the air-sending device, such as a fan (not illustrated), and the heat source side refrigerant, and evaporates and gasifies or condenses and liquefies the heat source side refrigerant. The accumulator 19 is provided on the suction side of the compressor 10 and retains excessive refrigerant due to a difference in the heating operation mode and the cooling operation mode or excessive refrigerant due to a transitional operation change.

The check valve 13*d* is provided in the refrigerant piping 4 between the heat medium relay unit 3 and the first refrigerant flow switching device 11 and permits the heat source side refrigerant to flow only in a predetermined direction (the direction from the heat medium relay unit 3 to the outdoor unit 1). The check valve 13*a* is provided in the refrigerant piping 4 between the heat source side heat exchanger 12 and the heat medium relay unit 3 and permits the heat source side refrigerant to flow only in a predetermined direction (the direction from the outdoor unit 1 to the heat medium relay unit 3). The check valve 13*b* is provided in the first connecting piping 4*a* and allows the heat source side refrigerant discharged from the compressor 10 to flow through the heat medium relay unit 3 during the heating operation. The check valve 13*c* is disposed in the second connecting piping 4*b* and allows the heat source side refrigerant, returning from the heat medium relay unit 3 to flow to the suction side of the compressor 10 during the heating operation.

The first connecting piping 4*a* connects the refrigerant piping 4, between the first refrigerant flow switching device 11 and the check valve 13*d*, to the refrigerant piping 4, between the check valve 13*a* and the heat medium relay unit 3, in the outdoor unit 1. The second connecting piping 4*b* is configured to connect the refrigerant piping 4, between the check valve 13*d* and the heat medium relay unit 3, to the refrigerant piping 4, between the heat source side heat exchanger 12 and the check valve 13*a*, in the outdoor unit 1. It should be noted that FIG. 3 illustrates a case in which the first connecting piping 4*a*, the second connecting piping 4*b*, the check valve 13*a*, the check valve 13*b*, the check valve 13*c*, and the check valve 13*d* are disposed, but the device is not limited to this case, and they do not necessarily have to be provided.

[Indoor Units 2]

The indoor units 2 each include a use side heat exchanger 26. The use side heat exchanger 26 is each connected to a heat medium flow control device 25 and a second heat medium flow switching device 23 in the heat medium relay unit 3 with the pipings 5. Each of the use side heat exchangers 26 exchanges heat between air supplied from an air-sending device, such as a fan, (not illustrated) and the heat medium in order to generate air for heating or air for cooling supplied to the indoor space 7.

FIG. 3 illustrates a case in which four indoor units 2 are connected to the heat medium relay unit 3. Illustrated are, from the bottom of the drawing, an indoor unit 2*a*, an indoor unit 2*b*, an indoor unit 2*c*, and an indoor unit 2*d*. In addition, the use side heat exchangers 26 are illustrated as, from the bottom of the drawing, a use side heat exchanger 26*a*, a use side heat exchanger 26*b*, a use side heat exchanger 26*c*, and a use side heat exchanger 26*d* each corresponding to the indoor units 2*a* to 2*d*. As is the case of FIGS. 1 and 2, the number of connected indoor units 2 illustrated in FIG. 3 is not limited to four.

[Heat Medium Relay Unit 3]

The heat medium relay unit 3 includes the two heat exchangers related to heat medium 15, two expansion devices 16, two on-off devices 17 (a first on-off device and a second on-off device), two second refrigerant flow switching devices 18, two pumps 21, four first heat medium flow switching devices 22, the four second heat medium flow switching devices 23, and the four heat medium flow control devices 25.

Each of the two heat exchangers related to heat medium 15 (the heat exchanger related to heat medium 15*a* and the heat exchanger related to heat medium 15*b*) functions as a condenser (radiator) or an evaporator and exchanges heat between the heat source side refrigerant and the heat medium in order to transfer cooling energy or heating energy, generated in the outdoor unit 1 and stored in the heat source side refrigerant, to the heat medium. The heat exchanger related to heat medium 15*a* is disposed between an expansion device 16*a* and a second refrigerant flow switching device 18*a* in the refrigerant circuit A and is used to cool the heat medium in the cooling and heating mixed operation mode. Additionally, the heat exchanger related to heat medium 15*b* is disposed between an expansion device 16*b* and a second refrigerant flow switching device 18*b* in the refrigerant circuit A and is used to heat the heat medium in the cooling and heating mixed operation mode.

The two expansion devices 16 (the expansion devices 16*a* and 16*b*) each have functions of a reducing valve and an expansion valve and are configured to reduce the pressure of and expand the heat source side refrigerant. The expansion device 16*a* is disposed upstream of the heat exchanger related to heat medium 15*a*, upstream regarding the heat source side refrigerant flow during the cooling operation. The expansion device 16*b* is disposed upstream of the heat exchanger related to heat medium 15*b*, upstream regarding the heat source side refrigerant flow during the cooling operation. Each of the two expansion devices 16 may include a component having a variably controllable opening degree, such as an electronic expansion valve.

The two on-off devices 17 (on-off devices 17*a* and 17*b*) each include, for example, a two-way valve and open and close the refrigerant piping 4. The on-off device 17*a* functions as the first on-off device and the on-off device 17*b* functions as the second on-off device, and each opening and closing is controlled so as to switch the refrigerant flow. The on-off device 17*a* is disposed in the refrigerant piping 4 on the inlet side of the heat source side refrigerant. The on-off device 17*b* is disposed in a piping connecting the refrigerant piping 4 on the inlet side of the heat source side refrigerant and the refrigerant piping 4 on an outlet side thereof.

The two second refrigerant flow switching devices 18 (the second refrigerant flow switching devices 18*a* and 18*b*) each include, for example, a four-way valve and switch passages of the heat source side refrigerant in accordance with the operation mode. The second refrigerant flow switching device 18*a* is disposed downstream of the heat exchanger related to heat medium 15*a*, downstream regarding the heat source side refrigerant flow during the cooling operation. The second refrigerant flow switching device 18*b* is disposed downstream of the heat exchanger related to heat medium 15*b*, downstream regarding the heat source side refrigerant flow during the cooling only operation mode.

Each of the second refrigerant flow switching device 18*a* and second refrigerant flow switching device 18*b* is connected to a high-pressure piping 40*a* and a low-pressure piping 40*b* and can be made to be in communication with the high-pressure piping 40*a* or the low-pressure piping 40*b* by ON/OFF of its electric power. In Embodiment, when the second refrigerant flow switching device 18*a* is in an OFF state, the flow switching device is in communication with the low-pressure piping 40*b*, and when in an ON state, is in communication with the high-pressure piping 40*a*. On the other hand, when the second refrigerant flow switching device 18*b* is in an OFF state, the flow switching device is in communication with the high-pressure piping 40*a*, and when in an ON state, is in communication with the low-pressure piping 40*b*.

The two pumps 21 (pump 21*a* and 21*b*) circulate the heat medium flowing through the piping 5. The pump 21*a* is disposed in the piping 5 between the heat exchanger related to heat medium 15*a* and the second heat medium flow switching devices 23. The pump 21*b* is disposed in the piping 5 between the heat exchanger related to heat medium 15*b* and the second heat medium flow switching devices 23. The two pumps 21 each include, for example, a capacity-controllable pump and may be one capable of controlling the flow rate according to the load in the indoor units 2.

The four first heat medium flow switching devices 22 (first heat medium flow switching devices 22*a* to 22*d*) each include, for example, a three-way valve and switch passages of the heat medium. The first heat medium flow switching devices 22 are arranged so that the number thereof (four in this case) corresponds to the installed number of indoor units 2. Each first heat medium flow switching device 22 is disposed on an outlet side of a heat medium passage of the corresponding use side heat exchanger 26 such that one of the three ways is connected to the heat exchanger related to heat medium 15*a*, another one of the three ways is connected to the heat exchanger related to heat medium 15*b*, and the other one of the three ways is connected to the corresponding heat medium flow control device 25. That is, each first heat medium flow switching device 22 switches the passage of the heat medium that is to flow into the corresponding indoor unit 2 between the heat exchanger related to heat medium 15*a* and the heat exchanger related to heat medium 15*b*.

Furthermore, illustrated from the bottom of the drawing are the first heat medium flow switching device 22*a*, the first heat medium flow switching device 22*b*, the first heat medium flow switching device 22*c*, and the first heat medium flow switching device 22*d*, so as to correspond to the respective indoor units 2. Further, regarding the switching of the heat medium passage, not only a complete switching from one to the other but also a partial switching from one to the other is also included.

The four second heat medium flow switching devices 23 (second heat medium flow switching devices 23*a* to 23*d*) each include, for example, a three-way valve and are configured to switch passages of the heat medium. The second heat medium flow switching devices 23 are arranged so that the number thereof (four in this case) corresponds to the installed number of indoor units 2. Each second heat medium flow switching device 23 is disposed on an inlet side of the heat medium passage of the corresponding use side heat exchanger 26 such that one of the three ways is connected to the heat exchanger related to heat medium 15*a*, another one of the three ways is connected to the heat exchanger related to heat medium 15*b*, and the other one of the three ways is connected to the corresponding use side heat exchanger 26. That is, along with the corresponding first heat medium flow switching device 22, each second heat medium flow switching device 23 switches the passage of the heat medium that is to flow into the corresponding indoor unit 2 between the heat exchanger related to heat medium 15*a* and the heat exchanger related to heat medium 15*b*.

Furthermore, illustrated from the bottom of the drawing are the second heat medium flow switching device 23*a*, the second heat medium flow switching device 23*b*, the second heat medium flow switching device 23*c*, and the second heat medium flow switching device 23*d* so as to correspond to the respective indoor units 2. Further, regarding the switching of the heat medium passage, not only a complete switching from one to the other but also a partial switching from one to the other is also included.

The four heat medium flow control devices 25 (heat medium flow control devices 25*a* to 25*d*) each include, for example, a two-way valve capable of controlling the area of opening and controls the flow rate of the heat medium flowing in piping 5. The heat medium flow control devices 25 are arranged so that the number thereof (four in this case) corresponds to the installed number of indoor units 2. Each heat medium flow control device 25 is disposed on the outlet side of the heat medium passage of the corresponding use side heat exchanger 26 such that one way is connected to the use side heat exchanger 26 and the other way is connected to the first heat medium flow switching device 22. That is, each heat medium flow control device 25 controls the amount of heat medium flowing into the corresponding indoor unit 2 by the temperatures of the heat medium flowing in and flowing out of the indoor unit 2, and thus is capable of supplying the optimum amount of heat medium to the indoor unit 2 in relation to the indoor load.

Furthermore, illustrated from the bottom of the drawing are the heat medium flow control device 25*a*, the heat medium flow control device 25*b*, the heat medium flow control device 25*c*, and the heat medium flow control device 25*d* so as to correspond to the respective indoor units 2. In addition, each of the heat medium flow control devices 25 may be disposed on the inlet side of the heat medium passage of the corresponding use side heat exchanger 26. Further, when no load is demanded in the indoor unit such as during stop and thermo-off, the heat medium flow control devices 25 may be totally closed, thus stopping the supply of the heat medium to the indoor units 2.

The heat medium relay unit 3 includes various detecting means (two first temperature sensors 31, four second temperature sensors 34, four third temperature sensors 35, and a pressure sensor 36). Information (temperature information and pressure information) detected by these detecting means are transmitted to a controller (not illustrated) that performs integrated control of the operation of the air-conditioning apparatus 100 such that the information is used to control, for example, the driving frequency of the compressor 10, the rotation speed of the air-sending device (not illustrated), switching of the first refrigerant flow switching device 11, the driving frequency of the pumps 21, switching of the second refrigerant flow switching devices 18, switching of the heat medium passage, and heat medium flow control of the indoor units 2.

Each of the two first temperature sensors 31 (a first temperature sensor 31*a* and a first temperature sensor 31*b*) detects the temperature of the heat medium flowing out of the corresponding heat exchanger related to heat medium 15, namely, the heat medium at an outlet of the corresponding heat exchanger related to heat medium 15 and may include, for example, a thermistor. The first temperature sensor 31*a* is disposed in the piping 5 on the inlet side of the pump 21*a*. The first temperature sensor 31*b* is disposed in the piping 5 on the inlet side of the pump 21*b*.

Each of the four second temperature sensors 34 (second temperature sensor 34*a* to 34*d*) is disposed between the corresponding first heat medium flow switching device 22 and heat medium flow control device 25 and detects the temperature of the heat medium flowing out of each use side heat exchanger 26. A thermistor or the like may be used as the second temperature sensor 34. The second temperature sensors 34 are arranged so that the number (four in this case) corresponds to the installed number of indoor units 2. Furthermore, illustrated from the bottom of the drawing are the second temperature sensor 34*a*, the second temperature sensor 34*b*, the second temperature sensor 34*c*, and the second temperature sensor 34*d* so as to correspond to the respective indoor units 2.

Each of the four third temperature sensors 35 (third temperature sensors 35*a* to 35*d*) is disposed on the inlet side or the outlet side of a heat source side refrigerant of the heat exchanger related to heat medium 15 and detects the temperature of the heat source side refrigerant flowing into the heat exchanger related to heat medium 15 or the temperature of the heat source side refrigerant flowing out of the heat exchanger related to heat medium 15 and may include, for example, a thermistor. The third temperature sensor 35*a* is disposed between the heat exchanger related to heat medium 15*a* and the second refrigerant flow switching device 18*a*. The third temperature sensor 35*b* is disposed between the heat exchanger related to heat medium 15*a* and the expansion device 16*a*. The third temperature sensor 35*c* is disposed between the heat exchanger related to heat medium 15*b* and the second refrigerant flow switching device 18*b*. The third temperature sensor 35*d* is disposed between the heat exchanger related to heat medium 15*b* and the expansion device 16*b*.

The pressure sensor 36 is disposed between the heat exchanger related to heat medium 15*b* and the expansion device 16*b*, similar to the installation position of the third temperature sensor 35*d*, and is configured to detect the pressure of the heat source side refrigerant flowing between the heat exchanger related to heat medium 15*b* and the expansion device 16*b*.

Further, the controller (not illustrated) includes, for example, a microcomputer and controls, for example, the driving frequency of the compressor 10, the rotation speed (including ON/OFF) of the air-sending device, switching of the first refrigerant flow switching device 11, driving of the pumps 21, the opening degree of each expansion device 16, on and off of each on-off device 17, switching of the second refrigerant flow switching devices 18, switching of the first heat medium flow switching devices 22, switching of the second heat medium flow switching devices 23, and the driving of each heat medium flow control device 25 on the basis of the information detected by the various detecting means and an instruction from a remote control to carry out the operation modes which will be described later. Note that the controller may be provided to each unit, or may be provided to the outdoor unit 1 or the heat medium relay unit 3.

The pipings 5 in which the heat medium flows include the pipings connected to the heat exchanger related to heat medium 15*a* and the pipings connected to the heat exchanger related to heat medium 15*b*. Each piping 5 is branched (into four in this case) in accordance with the number of indoor units 2 connected to the heat medium relay unit 3. The pipings 5 are connected with the first heat medium flow switching devices 22 and the second heat medium flow switching devices 23. Controlling the first heat medium flow switching devices 22 and the second heat medium flow switching devices 23 determines whether the heat medium flowing from the heat exchanger related to heat medium 15*a* is allowed to flow into the use side heat exchanger 26 or whether the heat medium flowing from the heat exchanger related to heat medium 15*b* is allowed to flow into the use side heat exchanger 26.

In the air-conditioning apparatus 100, the compressor 10, the first refrigerant flow switching device 11, the heat source side heat exchanger 12, the on-off devices 17, the second refrigerant flow switching devices 18, a refrigerant passage of the heat exchanger related to heat medium 15*a*, the expansion devices 16, and the accumulator 19 are connected through the refrigerant piping 4, thus forming the refrigerant circuit A. In addition, a heat medium passage of the heat exchanger related to heat medium 15*a*, the pumps 21, the first heat medium flow switching devices 22, the heat medium flow control devices 25, the use side heat exchangers 26, and the second heat medium flow switching devices 23 are connected through the pipings 5, thus forming the heat medium circuit B. In other words, the plurality of use side heat exchangers 26 are connected in parallel to each of the heat exchangers related to heat medium 15, thus turning the heat medium circuit B into a multi-system.

Accordingly, in the air-conditioning apparatus 100, the outdoor unit 1 and the heat medium relay unit 3 are connected through the heat exchanger related to heat medium 15*a* and the heat exchanger related to heat medium 15*b* arranged in the heat medium relay unit 3. The heat medium relay unit 3 and each indoor unit 2 are connected through the heat exchanger related to heat medium 15*a* and the heat exchanger related to heat medium 15*b*. In other words, in the air-conditioning apparatus 100, the heat exchanger related to heat medium 15*a* and the heat exchanger related to heat medium 15*b* each exchange heat between the heat source side refrigerant circulating in the refrigerant circuit A and the heat medium circulating in the heat medium circuit B.

Figure 4:
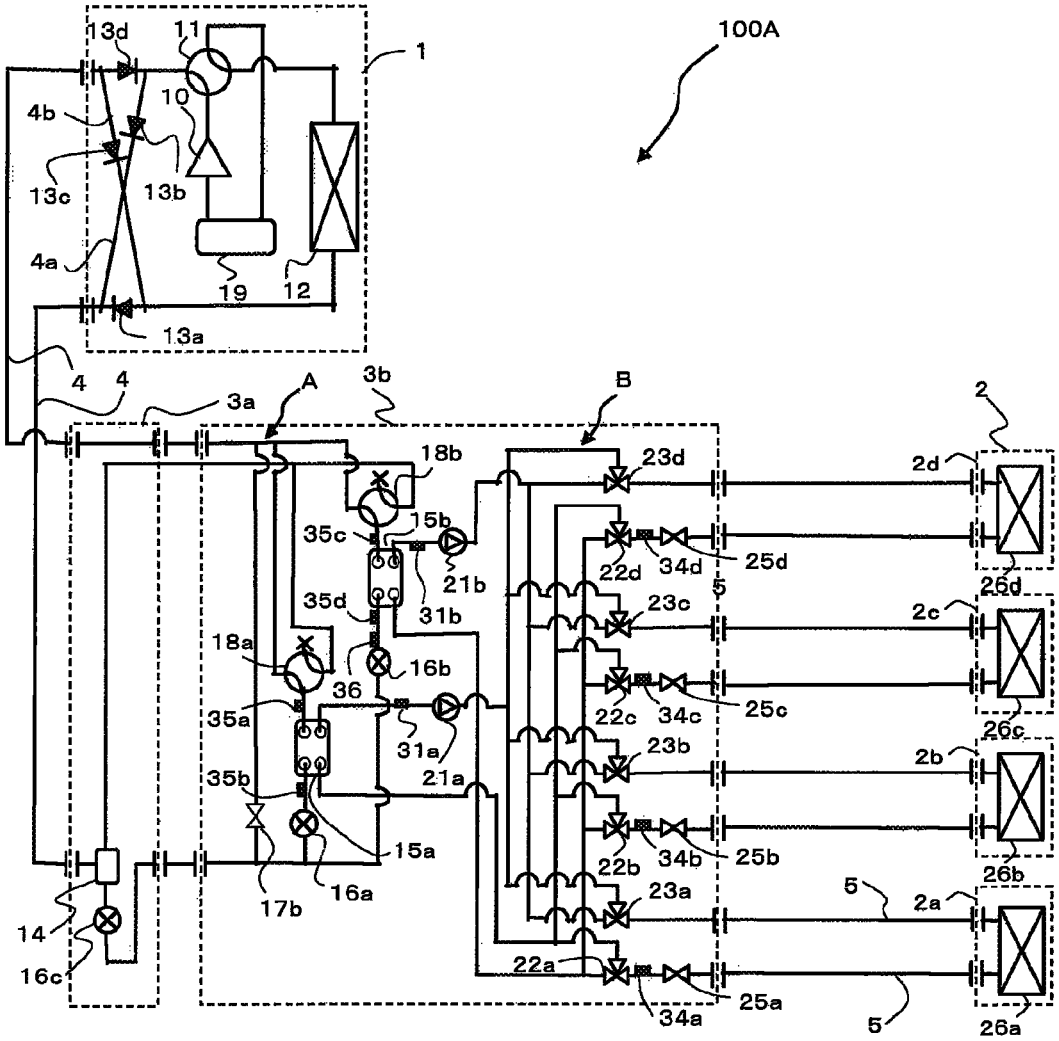
FIG. 4 is another schematic circuit illustrating an exemplary circuit configuration of the air-conditioning apparatus according to Embodiment of the invention.

FIG. 4 is a schematic circuit diagram illustrating an exemplary circuit configuration of the air-conditioning apparatus (hereinafter, referred to as an "air-conditioning apparatus 100A") according to Embodiment of the invention. The circuit configuration of the air-conditioning apparatus 100A in a case in which a heat medium relay unit 4 is separated into a main heat medium relay unit 3*a* and a sub heat medium relay unit 3*b* will be described with reference to FIG. 4. As illustrated in FIG. 4, a housing of the heat medium relay unit 3 is separated such that the heat medium relay unit 3 is composed of the main heat medium relay unit 3*a* and the sub heat medium relay unit 3*b*. This separation allows a plurality of sub heat medium relay units 3*b* to be connected to the single main heat medium relay unit 3*a* as illustrated in FIG. 2.

The main heat medium relay unit 3*a* includes a gas-liquid separator 14 and an expansion device 16*c*. Other components are arranged in the sub heat medium relay unit 3*b*. The gas-liquid separator 14 is connected to a single refrigerant piping 4 connected to an outdoor unit 1 and is connected to two refrigerant pipings 4 connected to a heat exchanger related to heat medium 15*a* and a heat exchanger related to heat medium 15*b* in the sub heat medium relay unit 3*b*, and is configured to separate heat source side refrigerant supplied from the outdoor unit 1 into vapor refrigerant and liquid refrigerant. The expansion device 16*c*, disposed downstream regarding the flow direction of the liquid refrigerant flowing out of the gas-liquid separator 14, has functions of a reducing valve and an expansion valve and reduces the pressure of and expands the heat source side refrigerant. During a cooling and heating mixed operation, the expansion device 16*c* is controlled such that the pressure in an outlet of the expansion device 16*c* is at a medium state. The expansion device 16*c* may include a component having a variably controllable opening degree, such as an electronic expansion valve. This arrangement allows a plurality of sub heat medium relay units 3*b* to be connected to the main heat medium relay unit 3*a*.

Various operation modes executed by the air-conditioning apparatus 100 will be described below. The air-conditioning apparatus 100 allows each indoor unit 2, on the basis of an instruction from the indoor unit 2, to perform a cooling operation or heating operation. Specifically, the air-conditioning apparatus 100 may allow all of the indoor units 2 to perform the same operation and also allow each of the indoor units 2 to perform different operations. It should be noted that since the same applies to operation modes carried out by the air-conditioning apparatus 100A, description of the operation modes carried out by the air-conditioning apparatus 100A is omitted. In the following description, the air-conditioning apparatus 100 includes the air-conditioning apparatus 100A.

The operation modes carried out by the air-conditioning apparatus 100 includes a cooling only operation mode in which all of the operating indoor units 2 perform the cooling operation, a heating only operation mode in which all of the operating indoor units 2 perform the heating operation, a cooling main operation mode that is a cooling and heating mixed operation mode in which the cooling load is larger than the heating load, and a heating main operation mode that is a cooling and heating mixed operation mode in which the heating load is larger than the cooling load. The operation modes will be described below with respect to the flow of the heat source side refrigerant and that of the heat medium.

[Cooling Only Operation Mode]

Figure 5:
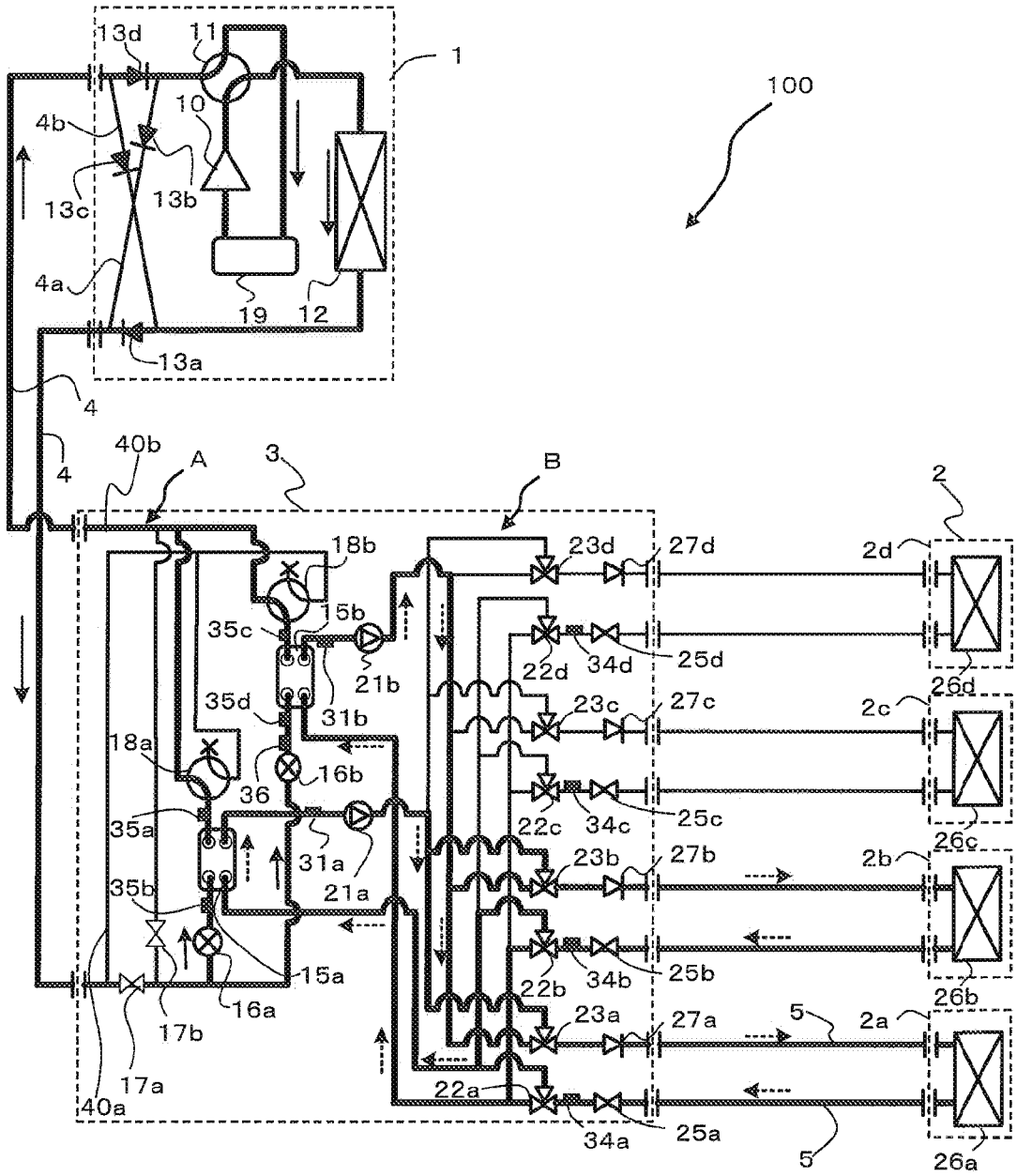
FIG. 5 is a refrigerant circuit diagram illustrating flows of refrigerants in a cooling only operation mode of the air-conditioning apparatus according to Embodiment of the invention.

FIG. 5 is a refrigerant circuit diagram illustrating the flows of the refrigerants in the cooling only operation mode of the air-conditioning apparatus 100. The cooling only operation mode will be described with respect to a case in which cooling loads are generated only in the use side heat exchanger 26*a* and the use side heat exchanger 26*b* in FIG. 5. Furthermore, in FIG. 5, pipings indicated by thick lines indicate pipings through which the refrigerants (the heat source side refrigerant and the heat medium) flow. In addition, the direction of flow of the heat source side refrigerant is indicated by solid-line arrows and the direction of flow of the heat medium is indicated by broken-line arrows in FIG. 5. Furthermore, operations of the second refrigerant flow switching device 18*a*, the second refrigerant flow switching device 18*b*, the on-off device 17*a*, and the on-off device 17*b* during the cooling only operation mode will be shown in Table 1.

In the cooling only operation mode illustrated in FIG. 5, the first refrigerant flow switching device 11 is switched such that the heat source side refrigerant discharged from the compressor 10 flows into the heat source side heat exchanger 12 in the outdoor unit 1. In the heat medium relay unit 3, the pump 21*a* and the pump 21*b* are driven, the heat medium flow control device 25*a* and the heat medium flow control device 25*b* are opened, and the heat medium flow control device 25*c* and the heat medium flow control device 25*d* are totally closed such that the heat medium circulates between each of the heat exchanger related to heat medium 15*a* and the heat exchanger related to heat medium 15*b* and each of the use side heat exchanger 26*a* and the use side heat exchanger 26*b*. Further, in the heat medium relay unit 3, the operations of the second refrigerant flow switching device 18*a*, the second refrigerant flow switching device 18*b*, the on-off device 17*a*, and the on-off device 17*b* are as shown in Table 1.

TABLE 1

| | |
|---|---|
| Second refrigerant flow switching device 18a | In communication with the low-pressure piping 40b |
| Second refrigerant flow switching device 18b | In communication with the low-pressure piping 40b |
| On-off device 17a | Opened |
| On-off device 17b | Closed |

Operation List of Actuators during Cooling Only Operation Mode

First, the flow of the heat source side refrigerant in the refrigerant circuit A will be described.

A low-temperature low-pressure refrigerant is compressed by the compressor 10 and is discharged as a high-temperature high-pressure gas refrigerant therefrom. The high-temperature high-pressure gas refrigerant that has been discharged from the compressor 10 flows through the first refrigerant flow switching device 11 into the heat source side heat exchanger 12. Then, the refrigerant is condensed and liquefied into a high-pressure liquid refrigerant while transferring heat to outdoor air in the heat source side heat exchanger 12. The high-pressure liquid refrigerant flowing out of the heat source side heat exchanger 12 passes through the check valve 13*a*, flows out of the outdoor unit 1, passes through the refrigerant piping 4, and flows into the heat medium relay unit 3. The high-pressure liquid refrigerant that has flowed into the heat medium relay unit 3 is branched after passing through the on-off device 17*a* and is expanded into a low-temperature low-pressure two-phase refrigerant by the expansion device 16*a* and the expansion device 16*b*.

This two-phase refrigerant flows into each of the heat exchanger related to heat medium 15*a* and the heat exchanger related to heat medium 15*b*, functioning as evaporators, removes heat from the heat medium circulating in the heat medium circuit B, cools the heat medium, and turns into a low-temperature low-pressure gas refrigerant. The gas refrigerant, which has flowed out of each of the heat exchanger related to heat medium 15*a* and the heat exchanger related to heat medium 15*b*, flows out of the heat medium relay unit 3 through the corresponding one of the second refrigerant flow switching device 18*a* and the second refrigerant flow switching device 18*b*, passes through the refrigerant piping 4, and again flows into the outdoor unit 1. The refrigerant that has flowed into the outdoor unit 1 passes through the check valve 13*d*, the first refrigerant flow switching device 11, and the accumulator 19, and is again sucked into the compressor 10.

At this time, the opening degree of the expansion device 16*a* is controlled such that superheat (the degree of superheat) is constant, the superheat being obtained as the difference between a temperature detected by the third temperature sensor 35*a* and that detected by the third temperature sensor 35*b*. Similarly, the opening degree of the expansion device 16*b* is controlled such that superheat is constant, in which the superheat is obtained as the difference between a temperature detected by a third temperature sensor 35*c* and that detected by a third temperature sensor 35*d*. Additionally, the on-off device 17*a* is opened and the on-off device 17*b* is closed.

Next, the flow of the heat medium in the heat medium circuit B will be described.

In the cooling only operation mode, both the heat exchanger related to heat medium 15*a* and the heat exchanger related to heat medium 15*b* transfer cooling energy of the heat source side refrigerant to the heat medium, and the pump 21*a* and the pump 21*b* allow the cooled heat medium to flow through the pipings 5. The heat medium, which has flowed out of each of the pump 21*a* and the pump 21*b* while being pressurized, flows through the second heat medium flow switching device 23*a* and the second heat medium flow switching device 23*b* into the use side heat exchanger 26*a* and the use side heat exchanger 26*b*. The heat medium removes heat from the indoor air in each of the use side heat exchanger 26*a* and the use side heat exchanger 26*b*, thus cools the indoor space 7.

Then, the heat medium flows out of the use side heat exchanger 26*a* and the use side heat exchanger 26*b* and flows into the heat medium flow control device 25*a* and the heat medium flow control device 25*b*, respectively. At this time, the function of each of the heat medium flow control device 25*a* and the heat medium flow control device 25*b* allows the heat medium to flow into the corresponding one of the use side heat exchanger 26*a* and the use side heat exchanger 26*b* while controlling the heat medium to a flow rate sufficient to cover an air conditioning load required in the indoor space. The heat medium, which has flowed out of the heat medium flow control device 25*a* and the heat medium flow control device 25*b*, passes through the first heat medium flow switching device 22*a* and the first heat medium flow switching device 22*b*, respectively, flows into the heat exchanger related to heat medium 15*a* and the heat exchanger related to heat medium 15*b*, and is again sucked into the pump 21*a* and the pump 21*b*.

Note that in the pipings 5 of each use side heat exchanger 26, the heat medium is directed to flow from the second heat medium flow switching device 23 through the heat medium flow control device 25 to the first heat medium flow switching device 22. The air conditioning load required in the indoor space 7 can be satisfied by controlling the difference between a temperature detected by the first temperature sensor 31*a* or a temperature detected by the first temperature sensor 31*b* and a temperature detected by the second temperature sensor 34 so that difference is maintained at a target value. As regards a temperature at the outlet of each heat exchanger related to heat medium 15, either of the temperature detected by the first temperature sensor 31*a* or that detected by the first temperature sensor 31*b* may be used. Alternatively, the mean temperature of the two may be used. At this time, the opening degree of each of the first heat medium flow switching devices 22 and the second heat medium flow switching devices 23 are set to a medium degree such that passages to both of the heat exchanger related to heat medium 15*a* and the heat exchanger related to heat medium 15*b* are established.

Upon carrying out the cooling only operation mode, since it is unnecessary to supply the heat medium to each use side heat exchanger 26 having no heat load (including thermo-off), the passage is closed by the corresponding heat medium flow control device 25 such that the heat medium does not flow into the corresponding use side heat exchanger 26. In FIG. 5, the heat medium is supplied to the use side heat exchanger 26*a* and the use side heat exchanger 26*b* because these use side heat exchangers have heat loads. The use side heat exchanger 26*c* and the use side heat exchanger 26*d* have no heat load and the corresponding heat medium flow control devices 25*c* and 25*d* are totally closed. When a heat load is generated in the use side heat exchanger 26*c* or the use side heat exchanger 26*d*, the heat medium flow control device 25*c* or the heat medium flow control device 25*d* may be opened such that the heat medium is circulated.

[Heating Only Operation Mode]

Figure 6:
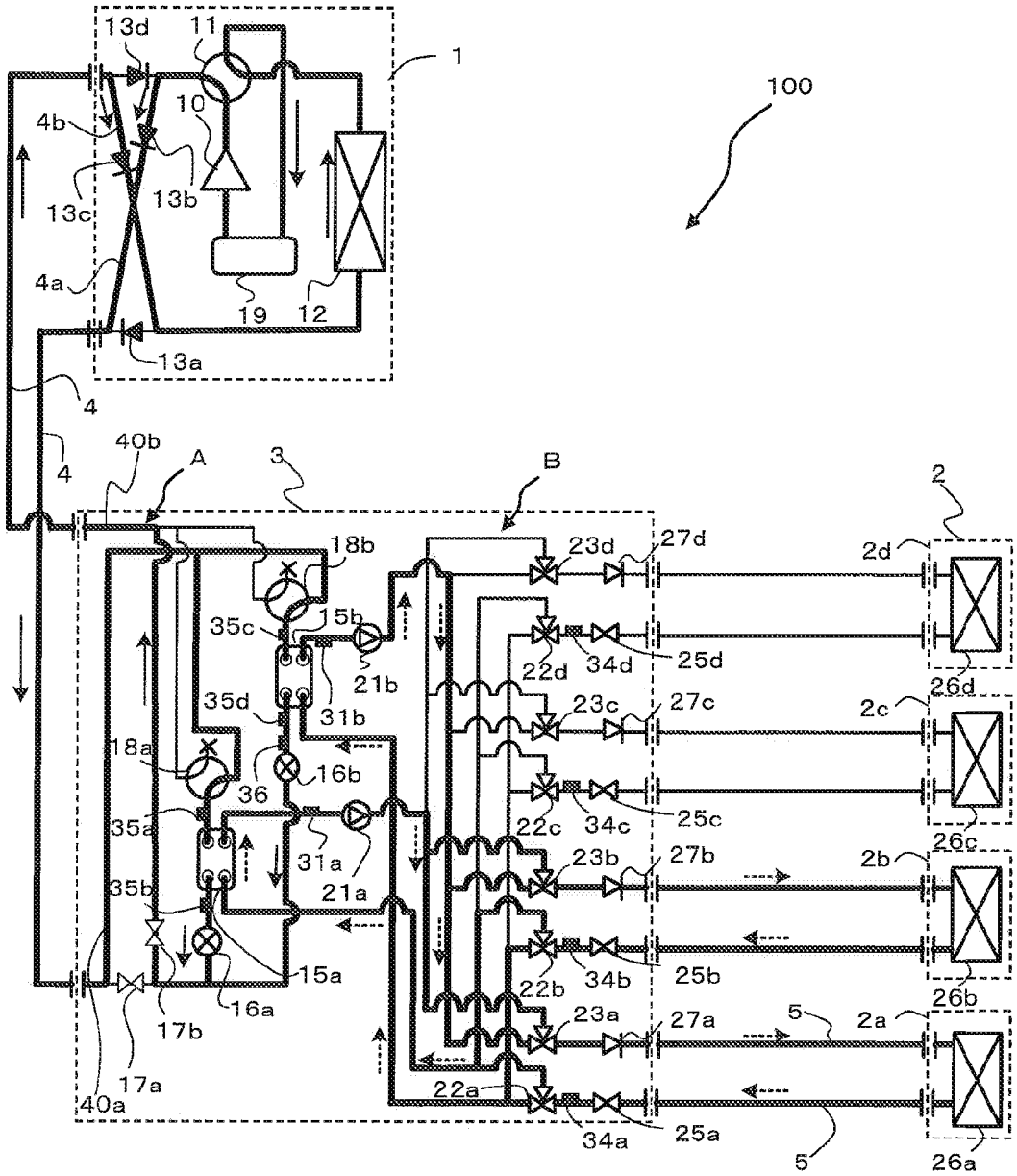
FIG. 6 is a refrigerant circuit diagram illustrating flows of refrigerants in a heating only operation mode of the air-conditioning apparatus according to Embodiment of the invention.

FIG. 6 is a refrigerant circuit diagram illustrating the flows of the refrigerants in the heating only operation mode of the air-conditioning apparatus 100. The heating only operation mode will be described with respect to a case in which heating loads are generated only in the use side heat exchanger 26*a* and the use side heat exchanger 26*b* in FIG. 6. Furthermore, in FIG. 6, pipings indicated by thick lines indicate pipings through which the refrigerants (the heat source side refrigerant and the heat medium) flow. In addition, the direction of flow of the heat source side refrigerant is indicated by solid-line arrows and the direction of flow of the heat medium is indicated by broken-line arrows in FIG. 6. Furthermore, operations of the second refrigerant flow switching device 18*a*, the second refrigerant flow switching device 18*b*, the on-off device 17*a*, and the on-off device 17*b* during the heating only operation mode will be shown in Table 2.

In the heating only operation mode illustrated in FIG. 6, the first refrigerant flow switching device 11 is switched such that the heat source side refrigerant discharged from the compressor 10 flows into the heat medium relay unit 3 without passing through the heat source side heat exchanger 12 in the outdoor unit 1. In the heat medium relay unit 3, the pump 21*a* and the pump 21*b* are driven, the heat medium flow control device 25*a* and the heat medium flow control device 25*b* are opened, and the heat medium flow control device 25*c* and the heat medium flow control device 25*d* are totally closed such that the heat medium circulates between each of the heat exchanger related to heat medium 15*a* and the heat exchanger related to heat medium 15*b* and each of the use side heat exchanger 26*a* and the use side heat exchanger 26*b*. Further, in the heat medium relay unit 3, the operations of the second refrigerant flow switching device 18*a*, the second refrigerant flow switching device 18*b*, the on-off device 17*a*, and the on-off device 17*b* are as shown in Table 2.

TABLE 2

| | |
|---|---|
| Second refrigerant flow switching device 18a | In communication with the high-pressure piping 40a |
| Second refrigerant flow switching device 18b | In communication with the high-pressure piping 40a |
| On-off device 17a | Closed |
| On-off device 17b | Opened |

Operation List of Actuators during Heating Only Operation Mode

First, the flow of the heat source side refrigerant in the refrigerant circuit A will be described.

A low-temperature low-pressure refrigerant is compressed by the compressor 10 and is discharged as a high-temperature high-pressure gas refrigerant therefrom. The high-temperature high-pressure gas refrigerant that has been discharged from the compressor 10 passes through the first refrigerant flow switching device 11, flows through the first connecting piping 4*a*, passes through the check valve 13*b*, and flows out of the outdoor unit 1. The high-temperature high-pressure gas refrigerant that has flowed out of the outdoor unit 1 passes through the refrigerant piping 4 and flows into the heat medium relay unit 3. The high-temperature high-pressure gas refrigerant that has flowed into the heat medium relay unit 3 is branched, passes through each of the second refrigerant flow switching device 18*a* and the second refrigerant flow switching device 18*b*, and flows into the corresponding one of the heat exchanger related to heat medium 15*a* and the heat exchanger related to heat medium 15*b*.

The high-temperature high-pressure gas refrigerant that has flowed into each of the heat exchanger related to heat medium 15*a* and the heat exchanger related to heat medium 15*b* is condensed and liquefied into a high-pressure liquid refrigerant while transferring heat to the heat medium circulating in the heat medium circuit B. The liquid refrigerant flowing out of the heat exchanger related to heat medium 15*a* and that flowing out of the heat exchanger related to heat medium 15*b* are expanded into a low-temperature low-pressure, two-phase refrigerant in the expansion device 16*a* and the expansion device 16*b*. This two-phase refrigerant passes through the on-off device 17*b*, flows out of the heat medium relay unit 3, passes through the refrigerant piping 4, and again flows into the outdoor unit 1. The refrigerant that has flowed into the outdoor unit 1 flows through the second connecting piping 4*b*, passes through the check valve 13*c*, and flows into the heat source side heat exchanger 12 functioning as an evaporator.

Then, the refrigerant that has flowed into the heat source side heat exchanger 12 removes heat from the outdoor air in the heat source side heat exchanger 12 and thus turns into a low-temperature low-pressure gas refrigerant. The low-temperature low-pressure gas refrigerant flowing out of the heat source side heat exchanger 12 passes through the first refrigerant flow switching device 11 and the accumulator 19 and is sucked into the compressor 10 again.

At that time, the opening degree of the expansion device 16*a* is controlled such that subcooling (degree of subcooling) obtained as the difference between a saturation temperature converted from a pressure detected by the pressure sensor 36 and a temperature detected by the third temperature sensor 35*b* is constant. Similarly, the opening degree of the expansion device 16*b* is controlled such that subcooling is constant, in which the subcooling is obtained as the difference between the value indicating the saturation temperature converted from the pressure detected by the pressure sensor 36 and a temperature detected by the third temperature sensor 35*d*. In addition, the on-off device 17*a* is closed and the on-off device 17*b* is opened. Note that when a temperature at the middle position of the heat exchangers related to heat medium 15 can be measured, the temperature at the middle position may be used instead of the pressure sensor 36. Accordingly, the system can be constructed inexpensively.

Next, the flow of the heat medium in the heat medium circuit B will be described.

In the heating only operation mode, both of the heat exchanger related to heat medium 15*a* and the heat exchanger related to heat medium 15*b* transfer heating energy of the heat source side refrigerant to the heat medium, and the pump 21*a* and the pump 21*b* allow the heated heat medium to flow through the pipings 5. The heat medium, which has flowed out of each of the pump 21*a* and the pump 21*b* while being pressurized, flows through the second heat medium flow switching device 23*a* and the second heat medium flow switching device 23*b* into the use side heat exchanger 26*a* and the use side heat exchanger 26*b*. Then the heat medium transfers heat to the indoor air in the use side heat exchanger 26*a* and the use side heat exchanger 26*b*, thus heats the indoor space 7.

Further, the heat medium flows out of the use side heat exchanger 26*a* and the use side heat exchanger 26*b* and flows into the heat medium flow control device 25*a* and the heat medium flow control device 25*b*, respectively. At this time, the function of each of the heat medium flow control device

25*a* and the heat medium flow control device 25*b* allows the heat medium to flow into the corresponding one of the use side heat exchanger 26*a* and the use side heat exchanger 26*b* while controlling the heat medium to a flow rate sufficient to cover an air conditioning load required in the indoor space. The heat medium, which has flowed out of the heat medium flow control device 25*a* and the heat medium flow control device 25*b*, passes through the first heat medium flow switching device 22*a* and the first heat medium flow switching device 22*b*, respectively, flows into the heat exchanger related to heat medium 15*a* and the heat exchanger related to heat medium 15*b*, and is again sucked into the pump 21*a* and the pump 21*b*.

Note that in the pipings 5 of each use side heat exchanger 26, the heat medium is directed to flow from the second heat medium flow switching device 23 through the heat medium flow control device 25 to the first heat medium flow switching device 22. The air conditioning load required in the indoor space 7 can be satisfied by controlling the difference between a temperature detected by the first temperature sensor 31*a* or a temperature detected by the first temperature sensor 31*b* and a temperature detected by the second temperature sensor 34 so that difference is maintained at a target value. As regards a temperature at the outlet of each heat exchanger related to heat medium 15, either of the temperature detected by the first temperature sensor 31*a* or that detected by the first temperature sensor 31*b* may be used. Alternatively, the mean temperature of the two may be used.

At this time, the opening degree of each of the first heat medium flow switching devices 22 and the second heat medium flow switching devices 23 are set to a medium degree such that passages to both of the heat exchanger related to heat medium 15*a* and the heat exchanger related to heat medium 15*b* are established. Although the use side heat exchanger 26*a* should essentially be controlled on the basis of the difference between a temperature at its inlet and that at its outlet, since the temperature of the heat medium on the inlet side of the use side heat exchanger 26 is substantially the same as that detected by the first temperature sensor 31*b*, the use of the first temperature sensor 31*b* can reduce the number of temperature sensors, so that the system can be constructed inexpensively.

Upon carrying out the heating only operation mode, since it is unnecessary to supply the heat medium to each use side heat exchanger 26 having no heat load (including thermo-off), the passage is closed by the corresponding heat medium flow control device 25 such that the heat medium does not flow into the corresponding use side heat exchanger 26. In FIG. 6, the heat medium is supplied to the use side heat exchanger 26*a* and the use side heat exchanger 26*b* because these use side heat exchangers have heat loads. The use side heat exchanger 26*c* and the use side heat exchanger 26*d* have no heat load and the corresponding heat medium flow control devices 25*c* and 25*d* are totally closed. When a heat load is generated in the use side heat exchanger 26*c* or the use side heat exchanger 26*d*, the heat medium flow control device 25*c* or the heat medium flow control device 25*d* may be opened such that the heat medium is circulated.

[Cooling Main Operation Mode]

Figure 7:
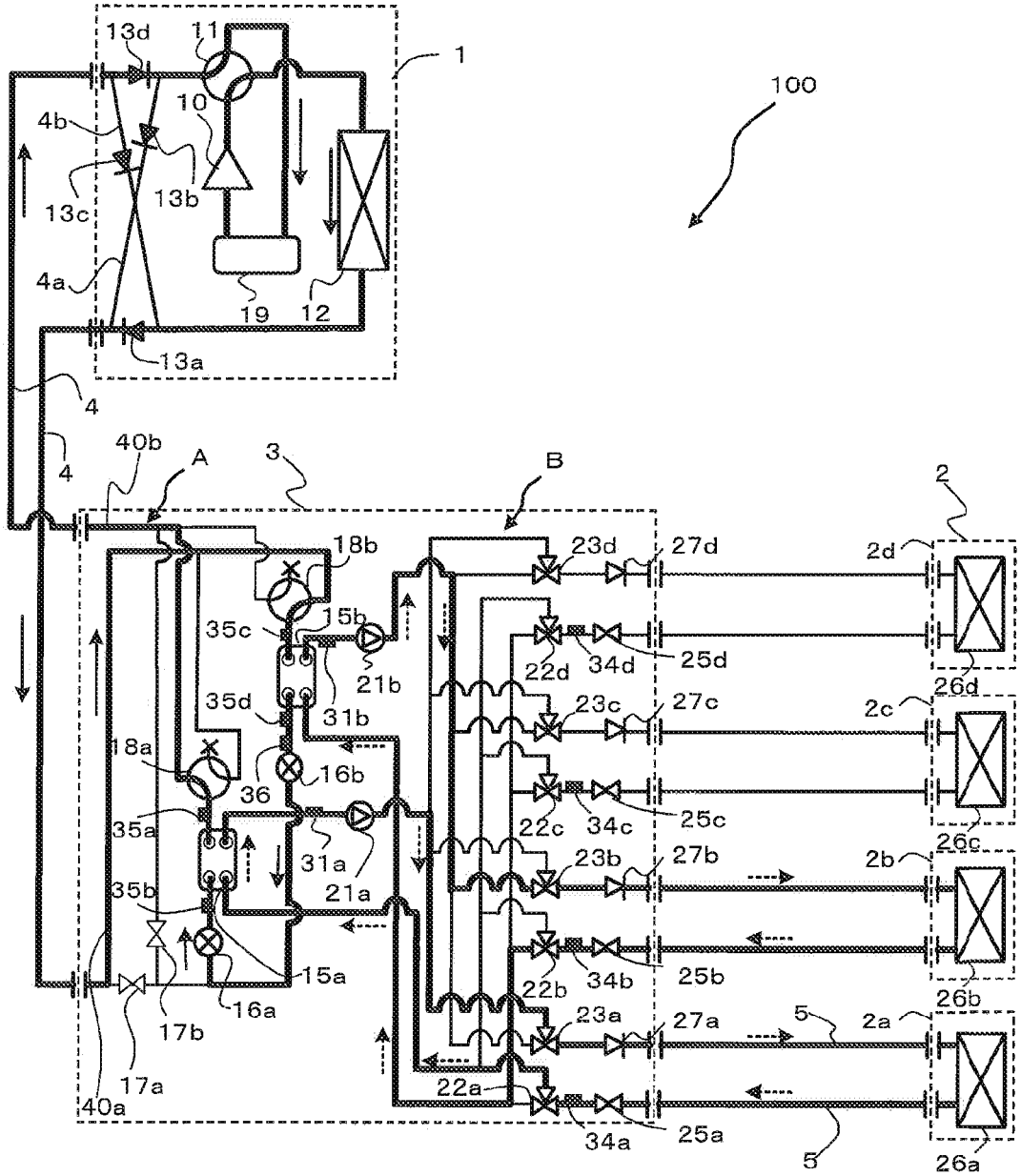
FIG. 7 is a refrigerant circuit diagram illustrating flows of refrigerants in a cooling main operation mode of the air-conditioning apparatus according to Embodiment of the invention.

FIG. 7 is a refrigerant circuit diagram illustrating the flows of the refrigerants in the cooling main operation mode of the air-conditioning apparatus 100. The cooling main operation mode will be described with respect to a case in which a cooling load is generated in the use side heat exchanger 26*a* and a heating load is generated in the use side heat exchanger 26*b* in FIG. 7. Furthermore, in FIG. 7, pipings indicated by thick lines correspond to pipings through which the refrigerants (the heat source side refrigerant and the heat medium) circulate. In addition, the direction of flow of the heat source side refrigerant is indicated by solid-line arrows and the direction of flow of the heat medium is indicated by broken-line arrows in FIG. 7. Furthermore, operations of the second refrigerant flow switching device 18*a*, the second refrigerant flow switching device 18*b*, the on-off device 17*a*, and the on-off device 17*b* during the cooling main operation mode will be shown in Table 3.

In the cooling main operation mode illustrated in FIG. 7, the first refrigerant flow switching device 11 is switched such that the heat source side refrigerant discharged from the compressor 10 flows into the heat source side heat exchanger 12 in the outdoor unit 1. In the heat medium relay unit 3, the pump 21*a* and the pump 21*b* are driven, the heat medium flow control device 25*a* and the heat medium flow control device 25*b* are opened, and the heat medium flow control device 25*c* and the heat medium flow control device 25*d* are totally closed such that the heat medium circulates between the heat exchanger related to heat medium 15*a* and the use side heat exchanger 26*a*, and between the heat exchanger related to heat medium 15*b* and the use side heat exchanger 26*b*. Further, in the heat medium relay unit 3, the operations of the second refrigerant flow switching device 18*a*, the second refrigerant flow switching device 18*b*, the on-off device 17*a*, and the on-off device 17*b* are as shown in Table 3.

TABLE 3

| | |
|---|---|
| Second refrigerant flow switching device 18a | In communication with the low-pressure piping 40b |
| Second refrigerant flow switching device 18b | In communication with the high-pressure piping 40a |
| On-off device 17a | Closed |
| On-off device 17b | Closed |

Operation List of Actuators during Cooling Main Operation Mode

First, the flow of the heat source side refrigerant in the refrigerant circuit A will be described.

A low-temperature low-pressure refrigerant is compressed by the compressor 10 and is discharged as a high-temperature high-pressure gas refrigerant therefrom. The high-temperature high-pressure gas refrigerant that has been discharged from the compressor 10 flows through the first refrigerant flow switching device 11 into the heat source side heat exchanger 12. The refrigerant is condensed into a two-phase refrigerant in the heat source side heat exchanger 12 while transferring heat to the outside air. The two-phase refrigerant flowing out of the heat source side heat exchanger 12 passes through the check valve 13*a*, flows out of the outdoor unit 1, passes through the refrigerant piping 4, and flows into the heat medium relay unit 3. The two-phase refrigerant flowing into the heat medium relay unit 3 passes through the second refrigerant flow switching device 18*b* and flows into the heat exchanger related to heat medium 15*b*, functioning as a condenser.

The two-phase refrigerant that has flowed into the heat exchanger related to heat medium 15*b* is condensed and liquefied while transferring heat to the heat medium circulating in the heat medium circuit B, and turns into a liquid refrigerant. The liquid refrigerant flowing out of the heat exchanger related to heat medium 15*b* is expanded into a low-pressure two-phase refrigerant by the expansion device 16*b*. This low-pressure two-phase refrigerant flows through the expansion device 16*a* and into the heat exchanger related to heat medium 15*a* functioning as an evaporator. The low-pressure two-phase refrigerant that has flowed into the heat exchanger related to heat medium 15*a* removes heat from the heat medium circulating in the heat medium circuit B, cools the heat medium, and turns into a low-pressure gas refrigerant. The gas refrigerant flows out of the heat exchanger related to heat medium 15*a*, passes through the second refrigerant flow switching device 18*a*, flows out of the heat medium relay unit 3, and flows into the outdoor unit 1 again through the refrigerant piping 4. The refrigerant that has flowed into the outdoor unit 1 passes through the check valve 13*d*, the first refrigerant flow switching device 11, and the accumulator 19, and is again sucked into the compressor 10.

At this time, the opening degree of the expansion device 16*b* is controlled such that superheat is constant, the superheat being obtained as the difference between a temperature detected by the third temperature sensor 35*a* and that detected by the third temperature sensor 35*b*. In addition, the expansion device 16*a* is fully opened, the on-off device 17*a* is closed, and the on-off device 17*b* is closed. Note that the opening degree of the expansion device 16*b* may be controlled such that subcooling is constant, in which the subcooling is obtained as the difference between a value indicating a saturation temperature converted from a pressure detected by the pressure sensor 36 and a temperature detected by the third temperature sensor 35*d*. Alternatively, the expansion device 16*b* may be fully opened and the expansion device 16*a* may control the superheat or the subcooling.

Next, the flow of the heat medium in the heat medium circuit B will be described.

In the cooling main operation mode, the heat exchanger related to heat medium 15*b* transfers heating energy of the heat source side refrigerant to the heat medium, and the pump 21*b* allows the heated heat medium to flow through the pipings 5. Furthermore, in the cooling main operation mode, the heat exchanger related to heat medium 15*a* transfers cooling energy of the heat source side refrigerant to the heat medium, and the pump 21*a* allows the cooled heat medium to flow through the pipings 5. The heat medium that has flowed out of each of the pump 21*a* and the pump 21*b* while being pressurized flows through the corresponding second heat medium flow switching device 23*a* and second heat medium flow switching device 23*b* into the corresponding use side heat exchanger 26*a* and the use side heat exchanger 26*b*.

In the use side heat exchanger 26*b*, the heat medium transfers heat to the indoor air, thus heats the indoor space 7. In addition, in the use side heat exchanger 26*a*, the heat medium removes heat from the indoor air, thus cools the indoor space 7. At this time, the function of each of the heat medium flow control device 25*a* and the heat medium flow control device 25*b* allows the heat medium to flow into the corresponding one of the use side heat exchanger 26*a* and the use side heat exchanger 26*b* while controlling the heat medium to a flow rate sufficient to cover an air conditioning load required in the indoor space. The heat medium, which has passed through the use side heat exchanger 26*b* with a slight decrease of temperature, passes through the heat medium flow control device 25*b* and the first heat medium flow switching device 22*b*, flows into the heat exchanger related to heat medium 15*b*, and is sucked into the pump 21*b* again. The heat medium, which has passed through the use side heat exchanger 26*a* with a slight increase of temperature, passes through the heat medium flow control device 25*a* and the first heat medium flow switching device 22*a*, flows into the heat exchanger related to heat medium 15*a*, and is then sucked into the pump 21*a* again.

During this time, the function of the first heat medium flow switching devices 22 and the second heat medium flow switching devices 23 allow the heated heat medium and the cooled heat medium to be introduced into the respective use side heat exchangers 26 having a heating load and a cooling load, without being mixed. Note that in the pipings 5 of each of the use side heat exchanger 26 for heating and that for cooling, the heat medium is directed to flow from the second heat medium flow switching device 23 through the heat medium flow control device 25 to the first heat medium flow switching device 22. Furthermore, the difference between the temperature detected by the first temperature sensor 31*b* and that detected by the second temperature sensor 34 is controlled such that the difference is kept at a target value, so that the heating air conditioning load required in the indoor space 7 can be covered. The difference between the temperature detected by the second temperature sensor 34 and that detected by the first temperature sensor 31*a* is controlled such that the difference is kept at a target value, so that the cooling air conditioning load required in the indoor space 7 can be covered.

Upon carrying out the cooling main operation mode, since it is unnecessary to supply the heat medium to each use side heat exchanger 26 having no heat load (including thermo-off), the passage is closed by the corresponding heat medium flow control device 25 such that the heat medium does not flow into the corresponding use side heat exchanger 26. In FIG. 7, the heat medium is supplied to the use side heat exchanger 26*a* and the use side heat exchanger 26*b* because these use side heat exchangers have heat loads. The use side heat exchanger 26*c* and the use side heat exchanger 26*d* have no heat load and the corresponding heat medium flow control devices 25*c* and 25*d* are totally closed. When a heat load is generated in the use side heat exchanger 26*c* or the use side heat exchanger 26*d*, the heat medium flow control device 25*c* or the heat medium flow control device 25*d* may be opened such that the heat medium is circulated.

[Heating Main Operation Mode]

Figure 8:
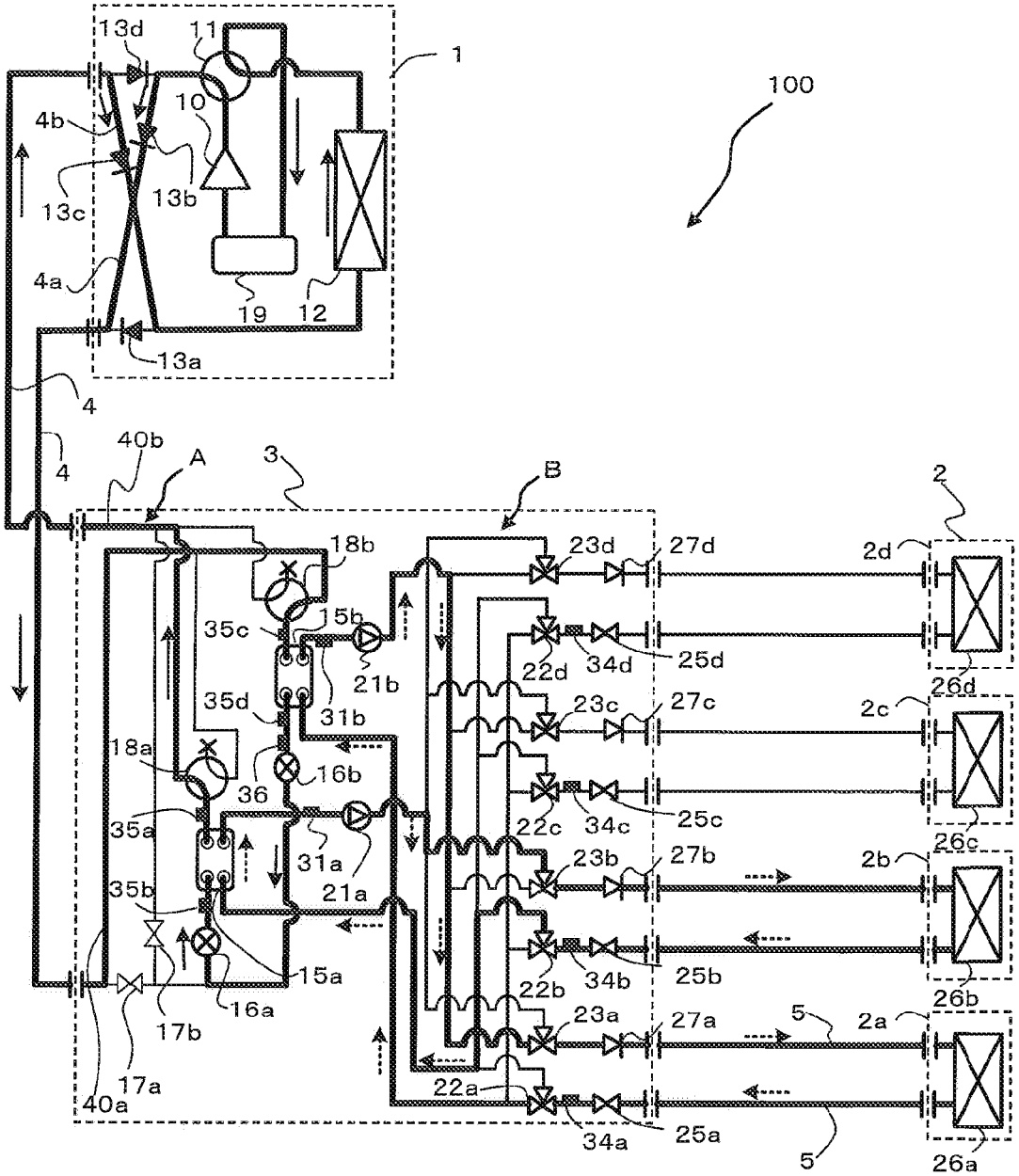
FIG. 8 is a refrigerant circuit diagram illustrating flows of refrigerants in a heating main operation mode of the air-conditioning apparatus according to Embodiment of the invention.

FIG. 8 is a refrigerant circuit diagram illustrating the flows of the refrigerants in the heating main operation mode of the air-conditioning apparatus 100. The heating main operation mode will be described with respect to a case in which a heating load is generated in the use side heat exchanger 26*a* and a cooling load is generated in the use side heat exchanger 26*b* in FIG. 8. Furthermore, in FIG. 8, pipings indicated by thick lines correspond to pipings through which the refrigerants (the heat source side refrigerant and the heat medium) circulate. In addition, the direction of flow of the heat source side refrigerant is indicated by solid-line arrows and the direction of flow of the heat medium is indicated by broken-line arrows in FIG. 8. Furthermore, operations of the second refrigerant flow switching device 18*a*, the second refrigerant flow switching device 18*b*, the on-off device 17*a*, and the on-off device 17*b* during the heating only operation mode will be shown in Table 4.

In the heating main operation mode illustrated in FIG. 8, in the outdoor unit 1, the first refrigerant flow switching device 11 is switched such that the heat source side refrigerant discharged from the compressor 10 flows into the heat medium relay unit 3 without passing through the heat source side heat exchanger 12. In the heat medium relay unit 3, the pump 21*a* and the pump 21*b* are driven, the heat medium flow control device 25*a* and the heat medium flow control device 25*b* are opened, and the heat medium flow control device 25*c* and the heat medium flow control device 25*d* are totally closed, such that the heat medium circulates between the heat exchanger related to heat medium 15*a* and the use side heat exchanger 26*b*, and between the heat exchanger related to heat medium 15*b* and the use side heat exchanger 26*a*. Further, in the heat medium relay unit 3, the operations of the second refrigerant flow switching device 18*a*, the second refrigerant flow switching device 18*b*, the on-off device 17*a*, and the on-off device 17*b* are as shown in Table 4.

TABLE 4

| | |
|---|---|
| Second refrigerant flow switching device 18a | In communication with the high-pressure piping 40a |
| Second refrigerant flow switching device 18b | In communication with the low-pressure piping 40b |
| On-off device 17a | Closed |
| On-off device 17b | Closed |

Operation List of Actuators during Heating Main Operation Mode

First, the flow of the heat source side refrigerant in the refrigerant circuit A will be described.

A low-temperature low-pressure refrigerant is compressed by the compressor 10 and is discharged as a high-temperature high-pressure gas refrigerant therefrom. The high-temperature high-pressure gas refrigerant that has been discharged from the compressor 10 passes through the first refrigerant flow switching device 11, flows through the first connecting piping 4*a*, passes through the check valve 13*b*, and flows out of the outdoor unit 1. The high-temperature high-pressure gas refrigerant that has flowed out of the outdoor unit 1 passes through the refrigerant piping 4 and flows into the heat medium relay unit 3. The high-temperature high-pressure gas refrigerant that has flowed into the heat medium relay unit 3 passes through the second refrigerant flow switching device 18*b* and flows into the heat exchanger related to heat medium 15*b* functioning as a condenser.

The gas refrigerant that has flowed into the heat exchanger related to heat medium 15*b* is condensed and liquefied while transferring heat to the heat medium circulating in the heat medium circuit B, and turns into a liquid refrigerant. The liquid refrigerant flowing out of the heat exchanger related to heat medium 15*b* is expanded into a low-pressure two-phase refrigerant by the expansion device 16*b*. This low-pressure two-phase refrigerant flows through the expansion device 16*a* and into the heat exchanger related to heat medium 15*a* functioning as an evaporator. The low-pressure two-phase refrigerant that has flowed into the heat exchanger related to heat medium 15*a* removes heat from the heat medium circulating in the heat medium circuit B, is evaporated, and cools the heat medium. This low-pressure two-phase refrigerant flows out of the heat exchanger related to heat medium 15*a*, passes through the second refrigerant flow switching device 18*a*, flows out of the heat medium relay unit 3, passes through the refrigerant piping 4, and again flows into the outdoor unit 1.

The refrigerant that has flowed into the outdoor unit 1 passes through the check valve 13*c* and flows into the heat source side heat exchanger 12 functioning as an evaporator. Then, the refrigerant that has flowed into the heat source side heat exchanger 12 removes heat from the outdoor air in the heat source side heat exchanger 12 and thus turns into a low-temperature low-pressure gas refrigerant. The low-temperature low-pressure gas refrigerant flowing out of the heat source side heat exchanger 12 passes through the first refrigerant flow switching device 11 and the accumulator 19 and is sucked into the compressor 10 again.

At this time, the opening degree of the expansion device 16*b* is controlled such that subcooling is constant, the subcooling being obtained as the difference between a value indicating a saturation temperature converted from a pressure detected by the pressure sensor 36 and a temperature detected by the third temperature sensor 35*b*. In addition, the expansion device 16*a* is fully opened, the on-off device 17*a* is closed, and the on-off device 17*b* is closed. Alternatively, the expansion device 16*b* may be fully opened and the expansion device 16*a* may control the subcooling.

Next, the flow of the heat medium in the heat medium circuit B will be described.

In the heating main operation mode, the heat exchanger related to heat medium 15*b* transfers heating energy of the heat source side refrigerant to the heat medium, and the pump 21*b* allows the heated heat medium to flow through the pipings 5. Furthermore, in the heating main operation mode, the heat exchanger related to heat medium 15*a* transfers cooling energy of the heat source side refrigerant to the heat medium, and the pump 21*a* allows the cooled heat medium to flow through the pipings 5. The heat medium, which has flowed out of each of the pump 21*a* and the pump 21*b* while being pressurized, flows through the second heat medium flow switching device 23*a* and the second heat medium flow switching device 23*b* into the use side heat exchanger 26*a* and the use side heat exchanger 26*b*.

In the use side heat exchanger 26*b*, the heat medium removes heat from the indoor air, thus cools the indoor space 7. In addition, in the use side heat exchanger 26*a*, the heat medium transfers heat to the indoor air, thus heats the indoor space 7. At this time, the function of each of the heat medium flow control device 25*a* and the heat medium flow control device 25*b* allows the heat medium to flow into the corresponding one of the use side heat exchanger 26*a* and the use side heat exchanger 26*b* while controlling the heat medium to a flow rate sufficient to cover an air conditioning load required in the indoor space. The heat medium, which has passed through the use side heat exchanger 26*b* with a slight increase of temperature, passes through the heat medium flow control device 25*b* and the first heat medium flow switching device 22*b*, flows into the heat exchanger related to heat medium 15*a*, and is sucked into the pump 21*a* again. The heat medium, which has passed through the use side heat exchanger 26*a* with a slight decrease of temperature, passes through the heat medium flow control device 25*a* and the first heat medium flow switching device 22*a*, flows into the heat exchanger related to heat medium 15*b*, and is again sucked into the pump 21*b*.

During this time, the function of the first heat medium flow switching devices 22 and the second heat medium flow switching devices 23 allow the heated heat medium and the cooled heat medium to be introduced into the respective use side heat exchangers 26 having a heating load and a cooling load, without being mixed. Note that in the pipings 5 of each of the use side heat exchanger 26 for heating and that for cooling, the heat medium is directed to flow from the second heat medium flow switching device 23 through the heat medium flow control device 25 to the first heat medium flow switching device 22. Furthermore, the difference between the temperature detected by the first temperature sensor 31*b* and that detected by the second temperature sensor 34 is controlled such that the difference is kept at a target value, so that the heating air conditioning load required in the indoor space 7 can be covered. The difference between the temperature detected by the second temperature sensor 34 and that detected by the first temperature sensor 31*a* is controlled such that the difference is kept at a target value, so that the cooling air conditioning load required in the indoor space 7 can be covered.

Upon carrying out the heating main operation mode, since it is unnecessary to supply the heat medium to each use side heat exchanger 26 having no heat load (including thermo-off), the passage is closed by the corresponding heat medium flow control device 25 such that the heat medium does not flow into the corresponding use side heat exchanger 26. In FIG. 8, the heat medium is supplied to the use side heat exchanger 26*a* and the use side heat exchanger 26*b* because these use side heat exchangers have heat loads. The use side heat exchanger 26*c* and the use side heat exchanger 26*d* have no heat load and the corresponding heat medium flow control devices 25*c* and 25*d* are totally closed. When a heat load is generated in the use side heat exchanger 26*c* or the use side heat exchanger 26*d*, the heat medium flow control device 25*c* or the heat medium flow control device 25*d* may be opened such that the heat medium is circulated.

[Refrigerant Piping 4]

As described above, the air-conditioning apparatus 100 according to Embodiment 1 has several operation modes. In these operation modes, the heat source side refrigerant flows through the refrigerant pipings 4 connecting the outdoor unit 1 and the heat medium relay unit 3. Note that in FIGS. 3 to 8, among the refrigerant pipings 4 that are connected to each of the second refrigerant flow switching devices 18, the piping on the high-pressure side is depicted as the high-pressure piping 40*a* and the piping on the low-pressure side is depicted as the low-pressure piping 40*b*.

[Piping 5]

In some operation modes carried out by the air-conditioning apparatus 100 according to Embodiment, the heat medium, such as water or antifreeze, flows through the pipings 5 connecting the heat medium relay unit 3 and the indoor units 2.

[Refrigerant Noise]

In the air-conditioning apparatus 100, when switching the operation mode or when suspending operation, the second refrigerant flow switching device 18*a* and the second refrigerant flow switching device 18*b* are switched. Accordingly, the pressure in the circuit (in the refrigerant circuit A) abruptly changes resulting in generation of refrigerant noise. Additionally, due to the large change in pressure in the circuit, when the refrigerant flows drastically through a narrow passage such as an expansion device (expansion device 16), large refrigerant noise is generated. Large refrigerant noise causes discomfort to the user. Air-conditioning apparatuses are demanded to reduce refrigerant noise. In order to reduce refrigerant noise, the cross section of the passage in which the refrigerant flows may be widened or the pressure difference before and after the expansion device may be made small.

In the air-conditioning apparatus 100, the refrigerant noise that is generated in accordance with the pressure change in the circuit is reduced. Specific examples of operating procedures of the actuators that reduce refrigerant noise will be described below on a case-by-case basis. Note that the unit stop mode described below refers to a mode executing a suspension control of each actuator when the operation of the air-conditioning apparatus 100 is stopped. An operation mode before switching of the operation mode is denoted as a first operation mode and that after switching is denoted as a second operation mode.

In the air-conditioning apparatus 100, the high-pressure piping 40*a* in which a refrigerant in a high pressure state flows is branched upstream of the on-off device 17*a* such that one way is connected to the on-off device 17*a* and the other way is connected to one of each of the connection ports of the second refrigerant flow switching devices 18. Further, in the air-conditioning apparatus 100, the low-pressure piping 40*b* in which a refrigerant in a low-pressure state flows is connected to one of each of the connection ports of the second refrigerant flow switching devices 18. As described above, the second refrigerant flow switching device 18*a* is in communication with the low-pressure piping 40*b* when in an OFF state and is in communication with the high-pressure piping 40*a* when in an ON state. Furthermore, the second refrigerant flow switching device 18*b* is in communication with the high-pressure piping 40*a* when in an OFF state and is in communication with the low-pressure piping 40*b* when in an ON state.

[Cooling Only Operation Mode (First Operation Mode) ⇒ Unit Stop Mode (Second Operation Mode)]

In the cooling only operation mode, the second refrigerant flow switching device 18*a* is in an OFF state (in a communicating state with the low-pressure piping 40*b*) and the second refrigerant flow switching device 18*b* is in an ON state (in a communicating state with the low-pressure piping 40*b*) (see Table 1). When switched to the unit stop mode in this state, the second refrigerant flow switching device 18*b* is switched to an OFF state. That is, when switched to the unit stop mode from the cooling only operation mode, the connection of the second refrigerant flow switching device 18*b* is switched from the low-pressure piping 40*b* to the high-pressure piping 40*a*. At this time, the heat exchanger related to heat medium 15*b* is instantaneously changed from a low-pressure state to a high-pressure state, causing a large pressure difference before and after the expansion device 16*b*, thus generating large refrigerant noise.

Accordingly, in the air-conditioning apparatus 100, when switching to the unit stop mode from the cooling only operation mode, the on-off device 17*a* is kept in the opened state and the second refrigerant flow switching device 18*a* is kept in the OFF state (the state that is in communication with the low-pressure piping 40*b*). Further, in the air-conditioning apparatus 100, when switching to the unit stop mode from the cooling only operation mode, the second refrigerant flow switching device 18*b* is switched to the OFF state (the state that is in communication with the high-pressure piping 40*a*) from the ON state (the state that is in communication with the low-pressure piping 40*b*) and each opening degree of the expansion device 16*a* and the expansion device 16*b* is made larger than the opening degree before the switching. The opening degree of each expansion device 16 is preferably fully opened since it should be as large as possible. Further, after elapse of a predetermined time period, each opening degree of the expansion device 16*a* and the expansion device 16*b* is set to a predetermined opening degree of the unit stop mode and the on-off device 17*a* is switched to a closed state.

By operating the actuators in the above order, the pressure difference at the expansion device 16*a* and the expansion device 16*b* can be made small. Accordingly, when switching to the unit stop mode from the cooling only operation mode, in the air-conditioning apparatus 100, the refrigerant noise can be reduced substantially.

[Cooling Only Operation Mode (First Operation Mode) ⇒ Cooling Main Operation Mode (Second Operation Mode)]

In the cooling only operation mode, the second refrigerant flow switching device 18*a* is in the OFF state (the state that is in communication with the low-pressure piping 40*b*) and the second refrigerant flow switching device 18*b* is in the ON state (the state that is in communication with the low-pressure piping 40*b*) (see Table 1). On the other hand, in the cooling main operation mode, since the heat exchanger related to heat medium 15*b* functions as a condenser, the second refrigerant flow switching device 18*b* is in the OFF state (the state that is in communication with the high-pressure piping 40*a*). That is, when switched to the cooling main operation mode from the cooling only operation mode, the second refrigerant flow switching device 18*b* is switched from the low-pressure piping 40*b* to the high-pressure piping 40*a*. At this time, the heat exchanger related to heat medium 15*b* is instantaneously changed from a low-pressure state to a high-pressure state, causing a large pressure difference before and after the expansion device 16*b*, thus generating large refrigerant noise.

Accordingly, in the air-conditioning apparatus 100, when switching to the cooling main operation from the cooling only operation mode, the on-off device 17*a* is kept in the opened state and the second refrigerant flow switching device 18*a* is kept in the OFF state (the state that is in communication with the low-pressure piping 40*b*). Further, in the air-conditioning apparatus 100, when switching to the cooling main operation mode from the cooling only operation mode, the second refrigerant flow switching device 18*b* is switched to the OFF state (the state that is in communication with the high-pressure piping 40*a*) from the ON state (the state that is in communication with the low-pressure piping 40*b*) and each opening degree of the expansion device 16*a* and the expansion device 16*b* is made larger than the opening degree before the switching. Further, after elapse of a predetermined time period, each opening degree of the expansion device 16*a* and the expansion device 16*b* is set to a predetermined opening degree of the cooling main operation mode and the on-off device 17*a* is switched to a closed state.

By operating the actuators in the above order, the pressure difference at the expansion device 16*a* and the expansion device 16*b* can be made small. Accordingly, when switching to the cooling main operation mode from the cooling only operation mode, in the air-conditioning apparatus 100, the refrigerant noise can be reduced substantially.

[Cooling Main Operation Mode (First Operation Mode) ⇒ Cooling Only Operation Mode (Second Operation Mode)]

In the cooling main operation mode, the second refrigerant flow switching device 18*a* is in the OFF state (the state that is in communication with the low-pressure piping 40*b*) and the second refrigerant flow switching device 18*b* is also in the OFF state (the state that is in communication with the high-pressure piping 40*a*) (see Table 3). When switched to the cooling only operation mode in this state, the second refrigerant flow switching device 18*b* is turned into the ON state (the state that is in communication with the low-pressure piping 40*b*) from the OFF state (the state that is in communication with the high-pressure piping 40*a*). That is, when switched to the cooling only operation mode from the cooling main operation mode, the second refrigerant flow switching device 18*b* is switched from the high-pressure piping 40*a* to the low-pressure piping 40*b*.

At this time, the heat exchanger related to heat medium 15*b* is instantaneously changed from a high-pressure state to a low-pressure state and the refrigerant flows into the low-pressure piping 40*b* drastically, thus generating large refrigerant noise when the refrigerant flows through a narrow passage such as an expansion device. Further, since the heat exchanger related to heat medium 15*b* functions as an evaporator, a large pressure difference before and after the expansion device 16*b* is caused, thus large refrigerant noise is generated.

Accordingly, in the air-conditioning apparatus 100, when switching to the cooling only operation from the cooling main operation mode, the on-off device 17*a* is switched to an opened state from a closed state and the second refrigerant flow switching device 18*a* is kept in the OFF state (the state that is in communication with the low-pressure piping 40*b*). Further, in the air-conditioning apparatus 100, when switching to the cooling only operation mode from the cooling main operation mode, the second refrigerant flow switching device 18*b* is also kept in the OFF state (the state that is in communication with the high-pressure piping 40*a*) and each opening degree of the expansion device 16*a* and the expansion device 16*b* is made larger than the opening degree before the switching. Further, after elapse of a predetermined time period, each opening degree of the expansion device 16*a* and the expansion device 16*b* is set to a predetermined opening degree of the cooling only operation mode and the second refrigerant flow switching device 18*b* is switched to the ON state (the state that is in communication with the low-pressure piping 40*b*) from the OFF state (the state that is in communication with the high-pressure piping 40*a*).

By operating the actuators in the above order, the pressure difference at the expansion device 16*b* can be made small. Accordingly, when switching to the cooling only operation mode from the cooling main operation mode, in the air-conditioning apparatus 100, the refrigerant noise can be reduced substantially.

[Heating Only Operation Mode (First Operation Mode) ⇒ Unit Stop Mode (Second Operation Mode)]

In the heating main operation mode, the second refrigerant flow switching device 18*a* is in the ON state (the state that is in communication with the high-pressure piping 40*a*) and the second refrigerant flow switching device 18*b* is also in the OFF state (the state that is in communication with the high-pressure piping 40*a*) (see Table 2). When switched to the unit stop mode in this state, the second refrigerant flow switching device 18*a* is turned into an OFF state. That is, when switched to the unit stop mode from the heating only operation mode, the connection of the second refrigerant flow switching device 18*a* is switched from the high-pressure piping 40*a* to the low-pressure piping 40*b*.

At this time, the heat exchanger related to heat medium 15*a* is instantaneously changed from a high-pressure state to a low-pressure state and the refrigerant flows into the low-pressure piping 40*b* drastically, thus generating large refrigerant noise when the refrigerant flows through a narrow passage such as an expansion device. Further, since the heat exchanger related to heat medium 15*a* functions as an evaporator, a large pressure difference before and after the expansion device 16*a* is caused, thus large refrigerant noise is generated.

Accordingly, in the air-conditioning apparatus 100, when switching to the unit stop mode from the heating only operation mode, the on-off device 17*b* is kept in the opened state, the second refrigerant flow switching device 18*a* is kept in the ON state (the state that is in communication with the high-pressure piping 40*a*), and the second refrigerant flow switching device 18*b* is also kept in the OFF state (the state that is in communication with the high-pressure piping 40*a*). Further, in the air-conditioning apparatus 100, when switching to the unit stop mode from the heating only operation mode, each opening degree of the expansion device 16*a* and the expansion device 16*b* is made larger than the opening degree before the switching. Furthermore, after elapse of a predetermined time period, each opening degree of the expansion device 16*a* and the expansion device 16*b* is set to a predetermined opening degree of the unit stop mode, the second refrigerant flow switching device 18*a* is switched to the OFF state (the state that is in communication with the low-pressure piping 40*b*), and the on-off device 17*b* is switched to a closed state.

By operating the actuators in the above order, the pressure difference at the expansion device 16*a* can be made small. Accordingly, when switching to the unit stop mode from the heating only operation mode, in the air-conditioning apparatus 100, the refrigerant noise can be reduced substantially.

[Heating Only Operation Mode (First Operation Mode) ⇒ Heating Main Operation Mode (Second Operation Mode)]

In the heating main operation mode, the second refrigerant flow switching device 18*a* is in the ON state (the state that is in communication with the high-pressure piping 40*a*) and the second refrigerant flow switching device 18*b* is in the OFF state (the state that is in communication with the high-pressure piping 40*a*) (see Table 2). On the other hand, in the heating main operation mode, since the heat exchanger related to heat medium 15*a* functions as an evaporator, the second refrigerant flow switching device 18*a* is in the OFF state (the state that is in communication with the low-pressure piping 40*b*). That is, when switched to the heating main operation mode from the heating only operation mode, the second refrigerant flow switching device 18*b* is switched from the high-pressure piping 40*a* to the low-pressure piping 40*b*.

At this time, the heat exchanger related to heat medium 15*a* is instantaneously changed from a high-pressure state to a low-pressure state and the refrigerant flows into the low-pressure piping 40*b* drastically, thus generating large refrigerant noise when the refrigerant flows through a narrow passage such as an expansion device. Further, since the heat exchanger related to heat medium 15*a* functions as an evaporator, a large pressure difference before and after the expansion device 16*a* is caused, thus large refrigerant noise is generated.

Accordingly, in the air-conditioning apparatus 100, when switching to the heating main operation mode from the heating only operation mode, the on-off device 17*b* is kept in the opened state, the second refrigerant flow switching device 18*a* is kept in the ON state (the state that is in communication with the high-pressure piping 40*a*), and the second refrigerant flow switching device 18*b* is also kept in the OFF state (the state that is in communication with the high-pressure piping 40*a*). Further, in the air-conditioning apparatus 100, when switching to the heating main operation mode from the heating only operation mode, each opening degree of the expansion device 16*a* and the expansion device 16*b* is made larger than the opening degree before the switching. Further, after elapse of a predetermined time period, the second refrigerant flow switching device 18*a* is switched to the OFF state (the state that is in communication with the low-pressure piping 40*b*) and the on-off device 17*b* is switched to a closed state. Furthermore, after elapse of a predetermined time period, each opening degree of the expansion device 16*a* and the expansion device 16*b* is set to a predetermined opening degree of the heating main operation mode.

By operating the actuators in the above order, the pressure difference at the expansion device 16*a* can be made small. Accordingly, when switching to the heating main operation mode from the heating only operation mode, in the air-conditioning apparatus 100, the refrigerant noise can be reduced substantially.

[Heating Main Operation Mode (First Operation Mode) ⇒ Heating Only Operation Mode (Second Operation Mode)]

In the heating main operation mode, the second refrigerant flow switching device 18*a* is in an OFF state (in a communicating state with the low-pressure piping 40*b*) and the second refrigerant flow switching device 18*b* is also in an OFF state (in a communicating state with the high-pressure piping 40*a*) (see Table 4). When switched to the heating only operation mode in this state, the second refrigerant flow switching device 18*a* is turned into the ON state (the state that is in communication with the high-pressure piping 40*a*) from the OFF state (the state that is in communication with the low-pressure piping 40*b*). That is, when switched to the heating only operation mode from the heating main operation mode, the second refrigerant flow switching device 18*a* is switched from the low-pressure piping 40*b* to the high-pressure piping 40*a*. At this time, the heat exchanger related to heat medium 15*a* is instantaneously changed from a low-pressure state to a high-pressure state and the refrigerant flows into the heat exchanger related to heat medium 15*a* drastically, thus generating large refrigerant noise when the refrigerant flows through a narrow passage.

Accordingly, in the air-conditioning apparatus 100, when switching to the heating only operation mode from the heating main operation mode, the on-off device 17*b* is kept in the opened state, the second refrigerant flow switching device 18*a* is kept in the OFF state (the state that is in communication with the low-pressure piping 40*b*), and the second refrigerant flow switching device 18*b* is also kept in the OFF state (the state that is in communication with the high-pressure piping 40*a*). Further, in the air-conditioning apparatus 100, when switching to the heating only operation mode from the heating main operation mode, each opening degree of the expansion device 16*a* and the expansion device 16*b* is made larger than the opening degree before the switching. Furthermore, after elapse of a predetermined time period, the second refrigerant flow switching device 18*a* is turned into the ON state (the state that is in communication with the high-pressure piping 40*a*) from the OFF state (the state that is in communication with the low-pressure piping 40*b*). Furthermore, after elapse of a predetermined time period, each opening degree of the expansion device 16*a* and the expansion device 16*b* is set to a predetermined opening degree of the heating only operation mode.

By operating the actuators in the above order, in the air-conditioning apparatus 100, the refrigerant noise can be made small substantially.

Furthermore, in the air-conditioning apparatus 100, in the case in which only the heating load or cooling load is generated in the use side heat exchangers 26, the corresponding first heat medium flow switching devices 22 and the corresponding second heat medium flow switching devices 23 are controlled so as to have a medium opening degree, such that the heat medium flows into both of the heat exchanger related to heat medium 15*a* and the heat exchanger related to heat medium 15*b*. Consequently, since both the heat exchanger related to heat medium 15*a* and the heat exchanger related to heat medium 15*b* can be used for the heating operation or the cooling operation, the heat transfer area can be increased, and accordingly the heating operation or the cooling operation can be efficiently performed.

In addition, in the case in which the heating load and the cooling load simultaneously occur in the use side heat exchangers 26, the first heat medium flow switching device 22 and the second heat medium flow switching device 23 corresponding to the use side heat exchanger 26 which performs the heating operation are switched to the passage connected to the heat exchanger related to heat medium 15*b* for heating, and the first heat medium flow switching device 22 and the second heat medium flow switching device 23 corresponding to the use side heat exchanger 26 which performs the cooling operation are switched to the passage connected to the heat exchanger related to heat medium 15*a* for cooling, so that the heating operation or cooling operation can be freely performed in each indoor unit 2.

Furthermore, each of the first heat medium flow switching devices 22 and the second heat medium flow switching devices 23 described in Embodiment may be any of the sort as long as they can switch passages, for example, a three-way valve capable of switching between three passages or a combination of two on-off valves and the like switching between two passages. Alternatively, components such as a stepping-motor-driven mixing valve capable of changing flow rates of three passages or electronic expansion valves capable of changing flow rates of two passages used in combination may be used as each of the first heat medium flow switching devices 22 and the second heat medium flow switching devices 23. In this case, water hammer caused when a passage is suddenly opened or closed can be prevented. Furthermore, while Embodiment has been described with respect to the case in which the heat medium flow control devices 25 each include a two-way valve, each of the heat medium flow control devices 25 may include a control valve having three passages and the valve may be disposed with a bypass piping that bypasses the corresponding use side heat exchanger 26.

Furthermore, as regards each of the heat medium flow control device 25, a stepping-motor-driven type that is capable of controlling a flow rate in the passage is preferably used. Alternatively, a two-way valve or a three-way valve whose one end is closed may be used. Alternatively, as regards each of the heat medium flow control device 25, a component, such as an on-off valve, which is capable of opening or closing a two-way passage, may be used while ON and OFF operations are repeated to control an average flow rate.

Furthermore, while each second refrigerant flow switching device 18 has been described as if it is a four-way valve, the device is not limited to this type. The device may be configured such that the refrigerant flows in the same manner using a plurality of two-way flow switching valves or three-way flow switching valves.

In addition, it is needless to say that the same holds true for the case in which only a single use side heat exchanger 26 and a single heat medium flow control device 25 are connected. Moreover, it is needless to say that no problem will arise even if the heat exchanger related to heat medium 15 and the expansion device 16 acting in the same manner are arranged in plural numbers. Furthermore, while the case in which the heat medium flow control devices 25 are equipped in the heat medium relay unit 3 has been described, the arrangement is not limited to this case. Each heat medium flow control device 25 may be disposed in the indoor unit 2. The heat medium relay unit 3 and the indoor unit 2 may be constituted in different housings.

As regards the heat source side refrigerant, a single refrigerant, such as R-22 or R-134a, a near-azeotropic refrigerant mixture, such as R-410A or R-404A, a non-azeotropic refrigerant mixture, such as R-407C, a refrigerant, such as CF3CF═CH2, containing a double bond in its chemical formula and having a relatively low global warming potential, a mixture containing the refrigerant, or a natural refrigerant, such as CO2 or propane, can be used. While the heat exchanger related to heat medium 15*a* or the heat exchanger related to heat medium 15*b* is operating for heating, a refrigerant that typically changes between two phases is condensed and liquefied and a refrigerant that turns into a supercritical state, such as CO2, is cooled in the supercritical state. As for the rest, either of the refrigerant acts in the same manner and offers the same advantages.

As regards the heat medium, for example, brine (antifreeze), water, a mixed solution of brine and water, or a mixed solution of water and an additive with high anticorrosive effect can be used. In the air-conditioning apparatus 100, therefore, even if the heat medium leaks into the indoor space 7 through the indoor unit 2, because the heat medium used is highly safe, contribution to improvement of safety can be made.

While Embodiment has been described with respect to the case in which the air-conditioning apparatus 100 includes the accumulator 19, the accumulator 19 may be omitted. Typically, a heat source side heat exchanger 12 and a use side heat exchanger 26 are provided with an air-sending device in which a current of air often facilitates condensation or evaporation. The structure is not limited to this case. For example, a heat exchanger, such as a panel heater, using radiation can be used as the use side heat exchanger 26 and a water-cooled heat exchanger that transfers heat using water or antifreeze can be used as the heat source side heat exchanger 12. In other words, as long as the heat exchanger is configured to be capable of transferring heat or removing heat, any type of heat exchanger can be used as each of the heat source side heat exchanger 12 and the use side heat exchanger 26.

Embodiment has been described in which the number of heat exchangers related to heat medium 26 is two. As a matter of course, the arrangement is not limited to this case. Furthermore, Description has been made illustrating a case in which there are two heat exchangers related to heat medium 15, namely, heat exchanger related to heat medium 15*a* and heat exchanger related to heat medium 15*b*. As a matter of course, the arrangement is not limited to this case, and as long as it is configured so that cooling and/or heating of the heat medium can be carried out, the number may be any number. Furthermore, each of the number of pumps 21*a* and that of pumps 21*b* is not limited to one. A plurality of pumps having a small capacity may be connected in parallel.

As described above, the air-conditioning apparatus 100 according to Embodiment not only increases safety by not allowing the heat source side refrigerant to circulate to or near the indoor units 2, but further increases safety by being able to store the heat medium that has leaked out of the connection of each actuator and the pipings 5 within the heat medium relay unit 3. Furthermore, the pipings 5 can be shortened in the air-conditioning apparatus 100, thus energy saving can be achieved. Still further, the air-conditioning apparatus 100 can reduce the connecting pipings (refrigerant pipings 4 and pipings 5) between the outdoor unit 1 and the heat medium relay unit 3, and between the heat medium relay unit 3 and the indoor units 2, thus increase ease of construction. Additionally, the air-conditioning apparatus 100 is capable of reducing the refrigerant temperature noise generated when switching the mode, thus is capable of improving comfortability.

REFERENCE SIGNS LIST

1 outdoor unit; 2 indoor unit; 2*a* indoor unit; 2*b* indoor unit; 2*c* indoor unit; 2*d* indoor unit; 3 heat medium relay unit; 3*a* main heat medium relay unit; 3*b* sub heat medium relay unit; 4 refrigerant piping; 4*a* first connecting piping; 4*b* second connecting piping; 5 piping; 6 outdoor space; 7 indoor space; 8 space; 9 structure; 10 compressor; 11 first refrigerant flow switching device; 12 heat source side heat exchanger; 13*a* check valve; 13*b* check valve; 13*c* check valve; 13*d* check valve; 14 gas-liquid separator; 15 heat exchanger related to heat medium; 15*a* heat exchanger related to heat medium; 15*b* heat exchanger related to heat medium; 16 expansion device; 16*a* expansion device; 16*b* expansion device; 16*c* expansion device; 17 on-off device; 17*a* on-off device; 17*b* on-off device; 18 second refrigerant flow switching device; 18*a* second refrigerant flow switching device; 18*b* second refrigerant flow switching device; 19 accumulator; 21 pump; 21*a* pump; 21*b* pump; 22 first heat medium flow switching device; 22*a* first heat medium flow switching device; 22*b* first heat medium flow switching device; 22*c* first heat medium flow switching device; 22*d* first heat medium flow switching device; 23 second heat medium flow switching device; 23*a* second heat medium flow switching device; 23*b* second heat medium flow switching device; 23*c* second heat medium flow switching device; 23*d* second heat medium flow switching device; 25 heat medium flow control device; 25*a* heat medium flow control device; 25*b* heat medium flow control device; 25*c* heat medium flow control device; 25*d* heat medium flow control device; 26 use side heat exchanger; 26*a* use side heat exchanger; 26*b* use side heat exchanger; 26*c* use side heat exchanger; 26*d* use side heat exchanger; 31 first temperature sensor; 31*a* first temperature sensor; 31*b* first temperature sensor; 34 second temperature sensor; 34*a* second temperature sensor; 34*b* second temperature sensor; 34*c* second temperature sensor; 34*d* second temperature sensor; 35 third temperature sensor; 35*a* third temperature sensor; 35*b* third temperature sensor; 35*c* third temperature sensor; 35*d* third temperature sensor; 36 pressure sensor; 40*a* high-pressure piping; 40*b* low-pressure piping; 100 air-conditioning apparatus; 100A air-conditioning apparatus; A refrigerant circuit; B heat medium circuit.

The invention claimed is:

1. An air-conditioning apparatus, comprising:

a refrigerant circuit in which a compressor, a first refrigerant flow switching device, a heat source side heat exchanger, a plurality of expansion devices, refrigerant side passages of a plurality of heat exchangers related to heat medium, and a plurality of second refrigerant flow switching devices are connected by refrigerant piping, the refrigerant circuit circulating a heat source side refrigerant;

a heat medium circuit in which a pump, at least two use side heat exchangers, and heat medium side passages of the heat exchangers related to heat medium are connected by heat medium piping, the heat medium circuit circulating a heat medium; and a first valve and a second valve provided in the refrigerant circuit, the heat source side refrigerant and the heat medium exchanging heat in the heat exchangers related to heat medium, wherein the air-conditioning apparatus has a cooling only operation mode in which control is performed such that the first valve is in an opened state and the second valve is in a closed state and in which a low-temperature low-pressure heat source side refrigerant is distributed to all of the heat exchangers related to heat medium wherein in the cooling only operation mode the first valve is arranged in the refrigerant circuit between the heat source side heat exchanger and the plurality of heat exchangers related to heat medium, and a unit stop mode in which operation of the air conditioning apparatus is stopped, at a time of switching to the unit stop mode from the cooling only operation mode, a state of the first valve is kept, either one of the second refrigerant flow switching devices is switched to a state that is in communication with a high-pressure piping from a state that is in communication with a low-pressure piping, and an opening degree of each of the expansion devices is made larger than an opening degree during the cooling only operation mode, and after elapse of a predetermined time period, after the unit stop mode is performed, the opening degree of each of the expansion devices is set to an opening degree of the unit stop mode and the first valve is switched to a closed state.

2. The air-conditioning apparatus of claim 1, wherein the air conditioning apparatus comprises:

a cooling main operation mode in which control is performed such that the first valve is in a closed state and the second valve is in a closed state, the cooling main operation mode being a cooling and heating mixed operation mode in which a heat medium for heating is heated by distributing a high-temperature high-pressure heat source side refrigerant to one or some of the heat exchangers related to heat medium while a heat medium for cooling is cooled by distributing the low-temperature low-pressure heat source side refrigerant to one or some of the remaining heat exchangers related to heat medium, at time of switching to the cooling main operation mode from the cooling only operation mode, a state of the first valve is kept, either one of the second refrigerant flow switching devices is switched to a state that is in communication with a high-pressure piping from a state that is in communication with a low-pressure piping, and an opening degree of each of the expansion devices is made larger than an opening degree during the cooling only operation mode, and after elapse of a predetermined time period, the cooling main operation mode is performed by setting the opening degree of each of the expansion devices to an opening degree of the cooling main operation mode and by switching the first valve to a closed state.

3. The air-conditioning apparatus of claim 1, wherein the air-conditioning apparatus comprises:

a cooling main operation mode in which control is performed such that the first valve is in a closed state and the second valve is in a closed state, the cooling main operation mode being a cooling and heating mixed operation mode in which the heat medium for heating is heated by distributing a high-temperature high-pressure heat source side refrigerant to one or some of the heat exchangers related to heat medium while the heat medium for cooling is cooled by distributing a low-temperature low-pressure heat source side refrigerant to one or some of the remaining heat exchangers related to heat medium, and in which cooling load is larger than heating load, at time of switching to the cooling only operation mode from the cooling main operation mode the first valve is switched to an opened state from the closed state, the states of the second refrigerant flow switching devices are kept, and an opening degree of each of the expansion devices is made larger than an opening degree during the cooling main operation mode, and after elapse of a predetermined time period, the cooling only operation mode is performed by setting the opening degree of each of the expansion devices to an opening degree of the cooling only operation mode and by switching the state of the second refrigerant flow switching device that is in communication with a high-pressure piping to a state that is in communication with a low-pressure piping.

4. The air-conditioning apparatus of claim 1, wherein the air-conditioning apparatus comprises:

a heating only operation mode in which control is performed such that the first valve is in a closed state and the second valve is in an opened state and in which a high-temperature high-pressure heat source side refrigerant is distributed to all of the heat exchangers related to heat medium, and a heating main operation mode in which control is performed such that the first valve is in a closed state and the second valve is in an closed state, the heating main operation mode being a cooling and heating mixed operation mode in which the heat medium for heating is heated by distributing the high-temperature high-pressure heat source side refrigerant to one or some of the heat exchangers related to heat medium while the heat medium for cooling is cooled by distributing a low-temperature low-pressure heat source side refrigerant to one or some of the remaining heat exchangers related to heat medium, and in which heating load is larger than cooling load, at time of switching to the heating main operation mode from the heating only operation mode a state of the second valve is kept, states of the second refrigerant flow switching devices are kept, and an opening degree of each of the expansion devices is made larger than an opening degree during the heating only operation mode, and after elapse of a predetermined time period, the heating main operation mode is performed by setting the opening degree of each of the expansion devices to an opening degree of the heating main operation mode after switching the state of the second refrigerant flow switching device that is in communication with a high-pressure piping to a state that is in communication with a low-pressure piping and switching the second valve to a closed state.

5. The air-conditioning apparatus of claim 1, wherein the air-conditioning apparatus comprises:

a heating main operation mode in which control is performed such that the first valve is in a closed state and the second valve is in a closed state, the heating main operation mode being a cooling and heating mixed operation mode in which the heat medium for heating is heated by distributing a high-temperature high-pressure heat source side refrigerant to one or some of the heat exchangers related to heat medium while the heat medium for cooling is cooled by distributing a low-temperature low-pressure heat source side refrigerant to one or some of the remaining heat exchangers related to heat medium, and in which heating load is larger than cooling load, and a heating only operation mode in which control is performed such that the first valve is in a closed state and the second valve is in an opened state and in which a high-temperature high-pressure heat source side refrigerant is distributed to all of the heat exchangers related to heat medium, and at time of switching to the heating only operation mode from the heating main operation mode the first valve is switched to an opened state from the closed state, the states of the second refrigerant flow switching devices are kept, and an opening degree of each of the expansion devices is made larger than an opening degree during the heating main operation mode, and after elapse of a predetermined time period, the heating only operation mode is performed by switching the state of the second refrigerant flow switching device that is in communication with a low-pressure piping to a state that is in communication with a high-pressure piping and by setting the opening degree of each of the expansion devices to an opening degree of the heating only operation mode.

* * * * *